US008876106B2

(12) United States Patent
Koyama et al.

(10) Patent No.: US 8,876,106 B2
(45) Date of Patent: Nov. 4, 2014

(54) RECORDING DEVICE

(71) Applicant: Seiko Epson Corporation, Tokyo (JP)

(72) Inventors: Kaoru Koyama, Nagano (JP); Yasuhiko Yoshihisa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/957,573

(22) Filed: Aug. 2, 2013

(65) Prior Publication Data

US 2014/0035218 A1 Feb. 6, 2014

(30) Foreign Application Priority Data

Aug. 3, 2012 (JP) ..... 2012-173170

(51) Int. Cl.

| | |
|---|---|
| ***B65H 43/04*** | (2006.01) |
| ***B41J 25/308*** | (2006.01) |
| ***B65H 31/20*** | (2006.01) |
| ***B65H 33/08*** | (2006.01) |

(52) U.S. Cl.

CPC ..... *B65H 31/20* (2013.01); *B65H 2301/42194* (2013.01); *B41J 25/308* (2013.01); *B65H 2301/4217* (2013.01); *B65H 2551/27* (2013.01); *B65H 2601/325* (2013.01); *B65H 2301/42192* (2013.01); *B65H 2511/20* (2013.01); *B65H 2551/26* (2013.01); *B65H 2511/11* (2013.01); *B65H 33/08* (2013.01); *B65H 2405/324* (2013.01); *B65H 2405/1412* (2013.01); *B65H 2513/40* (2013.01); *B65H 2801/12* (2013.01); *B65H 2403/731* (2013.01); *B65H 2403/942* (2013.01); *B65H 2553/51* (2013.01)

USPC ..... 271/215; 399/405

(58) Field of Classification Search

CPC ..... B65H 33/08; B65H 31/10; B65H 31/20; B65H 43/06; B65H 31/08; G03G 15/6552; G03G 2215/00421

USPC ..... 271/213–215, 223; 399/405

See application file for complete search history.

(56) References Cited

U.S. PATENT DOCUMENTS

| | | | | |
|---|---|---|---|---|
| 6,073,925 | A * | 6/2000 | Sato | 271/171 |
| 7,070,350 | B2 * | 7/2006 | Inokuchi et al. | 400/680 |
| 7,658,490 | B2 * | 2/2010 | Hwang et al. | 347/108 |
| 2006/0204310 | A1 | 9/2006 | Inokuchi et al. | |

FOREIGN PATENT DOCUMENTS

| | | |
|---|---|---|
| JP | 2004-338873 A | 12/2004 |

* cited by examiner

*Primary Examiner* — Michael McCullough
(74) *Attorney, Agent, or Firm* — Global IP Counselors, LLP

(57) ABSTRACT

To provide a recording device enabling unencumbered movement of a stacker to a target position at which an amount of extension that corresponds to the length of a medium is reached, a printer is provided with a conveyance unit for conveying paper, a paper length determination unit for determining the length of the paper in the direction of conveyance of the paper, a recording unit for recording onto the paper being conveyed, one stacker for receiving the already-recorded paper, an electric motor for driving the stacker, and a controller for controlling the electric motor. The controller (in particular, a stacker control unit) controls the electric motor and controls the stacker to a position at which the amount of extension that corresponds to the length of the paper is reached.

6 Claims, 16 Drawing Sheets

OPERATING PATTERN FOR THE COMPARATIVE EXAMPLE

OPERATING PATTERN FOR THE PRESENT EMBODIMENT

D1

| STACKER STATE | CLOSED STACKER SENSOR 55 | OPEN STACKER SENSOR 56 |
|---|---|---|
| STACKER OPEN | L | H |
| STACKER HALF-OPEN (OPEN ~ CLOSED) | L | L |
| STACKER CLOSED | H | L |

D2

| PAPER LENGTH | L1 | L2 | L2 | L3 | L3 | L3 |
|---|---|---|---|---|---|---|
| STACK NUMBER S | 1 | 1 | 2 | 1 | 2 | 3 |
| UPPER LIMIT SHEET NUMBER $N_{max}$ | 50 | 50 | 50 | 50 | 50 | 50 |
| UPPER LIMIT TOTAL SHEET NUMBER Nt | 50 | 50 | 100 | 50 | 100 | 150 |

PAPER LENGTH L1 > L2 > L3

D3

| PAPER LENGTH | PAPER LENGTH | AMOUNT OF STACKER EXTENSION (PAPER EXTENSION AMOUNT) |
|---|---|---|
| L1 | 1 | So-30 (60 mm) |
| | 2 | So-15 (45 mm) |
| | 3 | So (30 mm) |
| L2 | 1 | So-45 (45 mm) |
| | 2 | So-30 (30 mm) |
| | 3 | So-15 (15 mm) |
| | 4 | So (0 mm) |
| L3 | 1 | So-60 (30 mm) |
| | 2 | So-45 (15 mm) |
| | 3 | So-30 (0 mm) |
| | 4 | So-15 (-15 mm) |
| | 5 | So (-30 mm) |

PAPER LENGTH L1 > L2 > L3
SO: AMOUNT OF EXTENSION OF STACKER WHEN COMPLETELY OPEN
AMOUNT OF SHIFTING ΔL = EXAMPLE 15-mm TOP MARGIN

RECORDING DEVICE

CROSS-REFERENCE TO RELATED APPLICATIONS

This application claims priority to Japanese Patent Application No. 2012-173170 filed on Aug. 3, 2012. The entire disclosure of Japanese Patent Application No. 2012-173170 is hereby incorporated herein by reference.

BACKGROUND

1. Technical Field

The present invention relates to a recording device in which a stacker for receiving a medium (paper or the like) having been discharged after recording is driven by a power source.

2. Background Technology

A well-known recording device includes a multi-stage paper catch tray (a stacker) in which a plurality of trays slide and which allows for driving for stretching and contracting uses the power of a power source (a motor) to stretch or contract (for example, patent document 1 and so forth). In such a recording device, the length of the paper and the amount of stretching of a paper catch tray (equivalent to the amount of extension) are compared, the motor is driven in a case where the amount of stretching of the paper catch tray is not adequate in comparison to the length of the paper, and, when thereafter the amount of stretching of the paper catch tray is adequate in comparison to the length of the paper, printing is started. Also disclosed is a configuration provided with a sensor (a paper catch tray state detecting means) for detecting whether the paper catch tray is in a stretched state or a contracted state, where printing is carried out when the sensor detects the paper catch tray as being in a stretched state but printing is prohibited when the sensor detects the paper catch tray as being in a contracted state.

Japanese Laid-open Patent Publication No. 2004-338873 (Patent Document 1) is an example of the related art.

SUMMARY

Problems to be Solved by the Invention

A problem has emerged, however, in that because the configuration is one where adjustments are made to the amount of extension (amount of stretching) of the paper catch tray corresponding to paper length by stretching or contracting the multi-stage paper catch tray, the load during stretching or contracting is greater due to the friction between the plurality of trays that constitute the multistage paper catch tray. For this reason, the comparatively greater load has made it difficult to stretch the paper catch tray smoothly to the target amount of extension. When, for example, there is a considerable load caused by the friction applied during stretching or contraction of the paper catch tray, a problem emerges in that the time needed for the paper catch tray to arrive at a target position where printing is allowed is longer, leading to, for example, a decline in the printing throughput.

The invention has been contrived in view of the foregoing problems, and one advantage thereof is to provide a recording device making it possible to smoothly move a stacker to a position where the amount of extension corresponds to the medium length.

Means Used to Solve the Above-Mentioned Problems

In order to achieve one of the advantages above, a recording device is provided with: a conveyance unit for conveying a medium; a determination unit for determining a length of the medium in a direction of conveyance of the medium; a recording unit for recording onto the medium being conveyed; one stacker that is able to move between a receiving position for receiving already-printed medium that has been discharged and a withdrawn position; a power source for driving the stacker; and a control unit for controlling the power source and moving the stacker to at least one receiving position, including a receiving position at which an amount of extension that corresponds to the length of the medium is reached.

According to the configuration described above, the configuration is of a single stacker, and thus the stacker can be moved to the receiving position for the amount of extension corresponding to the length of the medium in a more unencumbered manner compared to a multi-stage stacker. In the recording device, preferably, the control unit moves the stacker to a plurality of receiving positions.

According to the configuration described above, at least two sheets of a plurality of sheets of the medium can be loaded onto the stacker with shifted positions. "With shifted positions" can refer to partial overlap or can refer to no overlap whatsoever, provided that the loading positions of the at least two sheets of the medium are shifted from each other.

In the recording device, preferably, the plurality of receiving positions are positions at which the medium can be stacked onto a plurality of respective stack positions on the stacker, and the control unit changes the stack position so that a number of stacked sheets of the medium is not greater than an upper limit value at each of the stack positions.

According to the configuration described above, a plurality of sheets of the medium are stacked separately at different stack positions on the stacker, at which time the number of stacked sheets of the medium stacked at each of the stack positions is kept to the upper limit value or lower. For this reason, it is easier to provide a load disruption for the already-recorded medium having been stacked onto the stacker. For example a load disruption due to too much medium being stacked can be avoided, as can a load disruption of the medium arising when, after an excessive number of sheets of the medium in excess of the upper limit value has been stacked, the medium discharged from a main device body comes up against the medium that has been stacked higher than a discharge height thereof.

In the recording device, preferably, in a case where a plurality of copies are to be recorded, the control unit changes the receiving position of the stacker when the discharging of the last sheet of the medium in the current copy is completed, and prior to the discharging of the first sheet of the medium for the next copy.

According to the configuration described above, in a case where a plurality of copies are to be recorded, the receiving position of the stacker is changed when the discharging of the last sheet of the medium in the current copy is completed, and prior to the discharging of the first sheet of the medium for the next copy. Accordingly, a plurality of sheets of the medium are stacked onto the stacker while being sorted copy by copy. For this reason, the user is able to eliminate the effort of dividing the medium copy by copy.

Further, in the recording device, preferably, the control unit changes the receiving position of the stacker by increasing the amount of extension of the stacker in a stepwise manner. According to the configuration described above, the receiving position of the stacker is changed by increasing the amount of extension of the stacker in a stepwise manner. For example, a sorting function can be implemented. Herein, a "sorting function" refers to loading at least two sheets of the medium shifted from each other onto the stacker; provided that the loading position is shifted, the at least two sheets of the medium can partially overlap or can not overlap at all.

Also, in the recording device, preferably, the control unit changes the receiving position of the stacker by moving the stacker forward and back in a direction of movement. According to the configuration described above, the receiving position of the stacker is changed by moving the stacker forward and back in a direction of movement. For example, a sorting function can be implemented. Herein, a "sorting function" refers to loading at least two sheets of the medium shifted from each other onto the stacker; provided that the loading position is shifted, the at least two sheets of the medium can partially overlap or can not overlap at all.

Also, in the recording device, preferably, the control unit controls the power source to move the stacker to a receiving position at which a part of the leading end side of the discharged already-recorded medium in the direction of discharging projects out beyond an end section of the stacker toward the direction of discharging of the discharged already-recorded medium, and the length by which the part of the leading end side projects out is less than half of the length of the already-recording medium in the direction of discharging.

According to the configuration described above, the control unit controls the power source to move the stacker to a receiving position at which a part of the leading end side of the discharged already-recorded medium in the direction of discharging projects out beyond an end section of the stacker toward the direction of discharging of the discharged already-recorded medium, by a length less than half of the length of the already-recording medium in the direction of discharging. The already-recorded medium, having been received by the stacker which is at this receiving position, has a part on the leading end side in the direction of discharging thereof that projects out beyond the distal end section of the stacker by a length less than half the length of the medium, and thus the user can easily take the already-recorded medium from the stacker.

A recording device is provided with: a conveyance unit for conveying a medium; a determination unit for determining a length of the medium in a direction of conveyance of the medium; a recording unit for recording onto the medium being conveyed; a stacker capable of moving between a receiving position for receiving the already-recorded medium having been discharged and a withdrawn position; an operation panel capable of rotating between a closed position intersecting with a movement route of the stacker and an open position not intersecting with the movement route; a power source for driving the stacker; an operation panel power source for driving the operation panel; and a control unit for controlling the power source to move the stacker to at least one receiving position inclusive of a receiving position at which an amount of extension that corresponds to the length of the medium is reached, and controlling the operation panel power source to rotate the operation panel; wherein the control unit avoids contact between the stacker and the operation panel to move the stacker to the receiver position by causing the operation panel to rotate in a direction going from the closed position toward the open position either during the driving of the stacker from the withdrawn position or prior to said driving.

According to the configuration described above, at least two sheets of a plurality of sheets of the medium can be loaded onto the stacker with shifted positions. "With shifted positions" can refer to partial overlap or can refer to no overlap whatsoever, provided that the loading positions of the at least two sheets of the medium are shifted from each other.

Arranging the operation panel further in the movement route of the stacker so as to intersect with the movement route of the stacker at the closed position makes it possible to achieve a recording device that is more compact in the height direction. Thus, even with a configuration in which the recording device is rendered more compact in the height direction, having the operation panel rotate in the direction going from the closed position toward the open position either during the driving of the stacker from the withdrawn position or prior to said driving ensures a movement route in which the stacker will not come into contact with the operation panel. For this reason, the stacker can be moved to the receiving position while avoiding contact with the operation panel. Accordingly, it is possible to achieve both a recording device provided with the operation panel that is more compact (thinner) in the height direction, and unencumbered movement whereby contact with the operation panel from the withdrawn position of the stacker is avoided.

BRIEF DESCRIPTION OF THE DRAWINGS

Referring now to the attached drawings which form a part of this original disclosure.

DETAILED DESCRIPTION OF EXEMPLARY EMBODIMENTS

First Embodiment

A first embodiment in which the recording device is embodied as a printer shall be described below on the basis of FIGS. 1 to 8.

Figure 1:
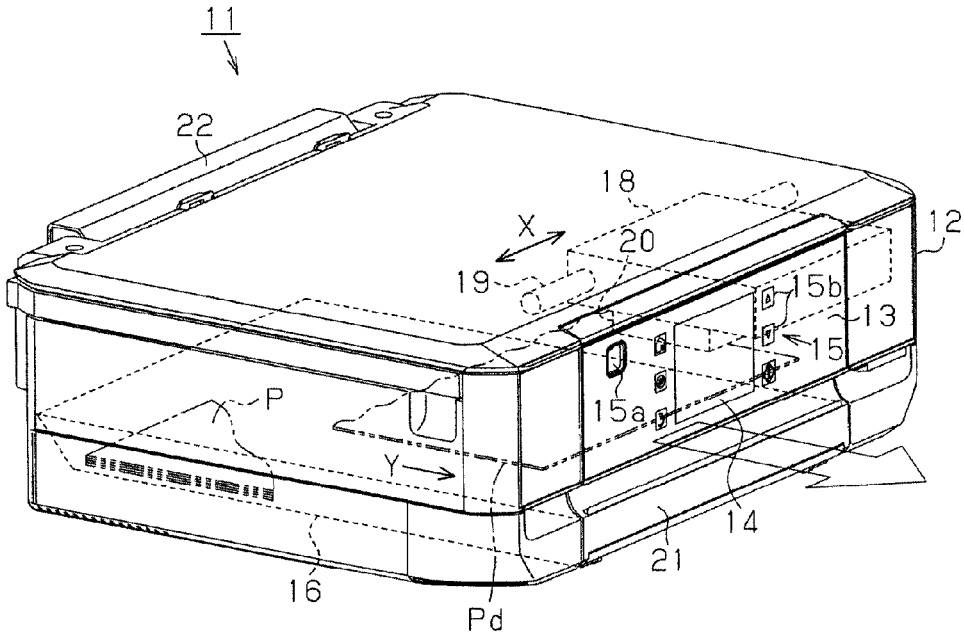
FIG. 1 is a perspective view of a printer in a first embodiment.

As illustrated in FIG. 1, a printer 11 is provided with: a main device body 12 having a thin, substantially rectangular parallelepiped shape; and an operation panel 13 which is provided to a front surface (in FIG. 1, the right-side surface) of the main device body 12 and is used for input operations of a user. The operation panel 13 is configured so as to be able to rotate forward in relation to the front surface of the main device body 12, the axis of rotation being an upper part thereof. Provided to the operation panel 13 are a display unit 14 including a liquid crystal panel or the like and an operation unit 15 including a plurality of operation switches. The operation unit 15 includes: a power source switch 15*a* for operations to turn a power source of the printer 11 either on or off; a selection switch 15*b* for operations to select a desired selection item on a menu screen displayed on the display unit 14; and the like.

As illustrated in FIG. 1, a supply cassette 16 able to hold a plurality of sheets of paper P, as one example of a medium, is mounted onto a lower position of the operation panel 13 on the front surface of the main device body 12 in a state of being detachable (insertable or removable). The plurality of sheets of paper P held in the supply cassette 16 are fed out one sheet at a time from the supply cassette 16 in order from a first sheet by a pick-up roller 17 (see FIG. 3); having been fed out, the paper P is then conveyed in a conveyance direction Y along a predetermined conveyance route.

Also provided within the main device body 12 is a carriage 18, in a state of being guided along a guide shaft 19 that is suspended so as to extend in a scan direction X that intersects with the carriage 18, and of being able to move reciprocatingly along the scan direction X. A recording head 20 having a plurality of nozzles for ejecting ink droplets onto the paper P being conveyed is attached to the bottom of the carriage 18. Already-printed paper Pd is discharged in the direction illustrated by the white arrow outlined in black in FIG. 1, from a discharge port that is exposed when a cover 21, provided to the front surface of the supply cassette 16 in a state of being able to rotate with the bottom being the axis of rotation, is in an opened state. Provided to the rear of the main device body 12 is an open/close cover 22 for blocking off an insertion port into which the paper P can be manually inserted, thus making it also possible to print by opening the cover 22 and manually inserting the paper P from the insertion port.

Figure 2:
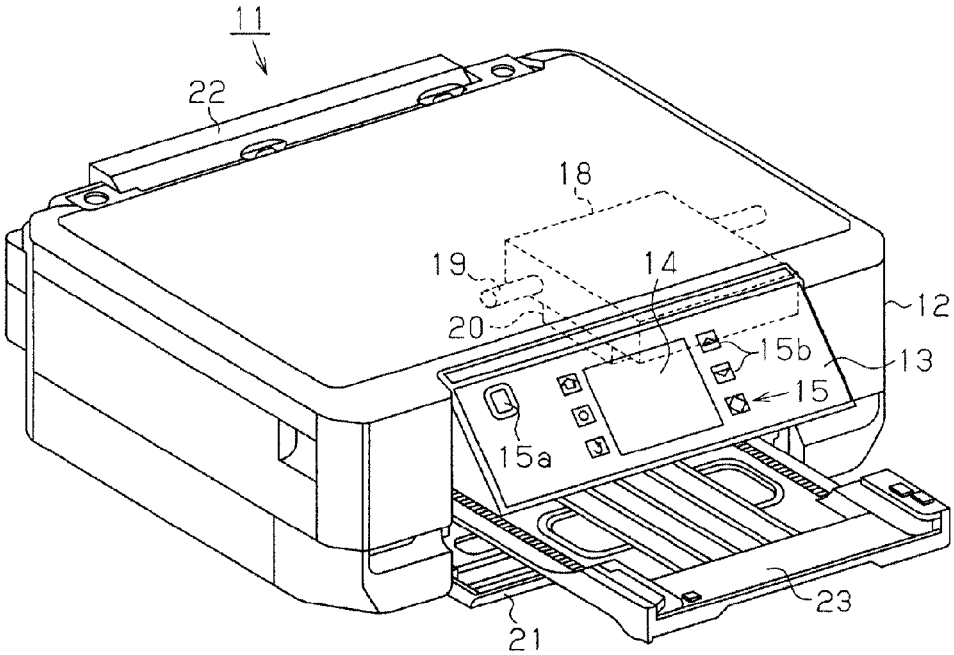
FIG. 2 is a perspective view of the printer in which a stacker is in an open state.

As illustrated in FIG. 2, a single stacker 23 (medium-receiving tray) constituted of a single tray of a substantially quadrangular, flat shape is provided to the main device body 12 in a state of being able to extend forth and retract (extend forth and withdraw) (in FIG. 2, however, a protruding state is depicted). The stacker 23 is motorized, and is enabled to move reciprocatingly between a closed position (withdrawn position) held within the main device body 12 (for example, the state in FIG. 1) and an open position protruding out by a maximum amount of extension (amount of protrusion) from the main device body 12 (for example, the state in FIG. 2). The operation panel 13 and the stacker 23 are driven by a shared power source, and in conjunction with an operation for the stacker 23 to protrude out from the closed position, the operation panel 13 rotates forward to be arranged in a posture of a predetermined angle of easy viewing for the user, as illustrated in FIG. 2. At this time, the cover 21 is opened by being pushed on by the stacker 23 en route to protruding out from the main device body 12. Then, the already-printed paper Pd is discharged onto the stacker 23, which is at a receiving position of an amount of extension corresponding to the paper length of the paper Pd (either the open position or a position where the amount of extension is less than the open position). Once opened, the operation panel 13 will be retained at the open position, even when the stacker 23 withdraws from the receiving position to the closed position. A mechanism therefor shall be described in greater detail below.

Figure 3:
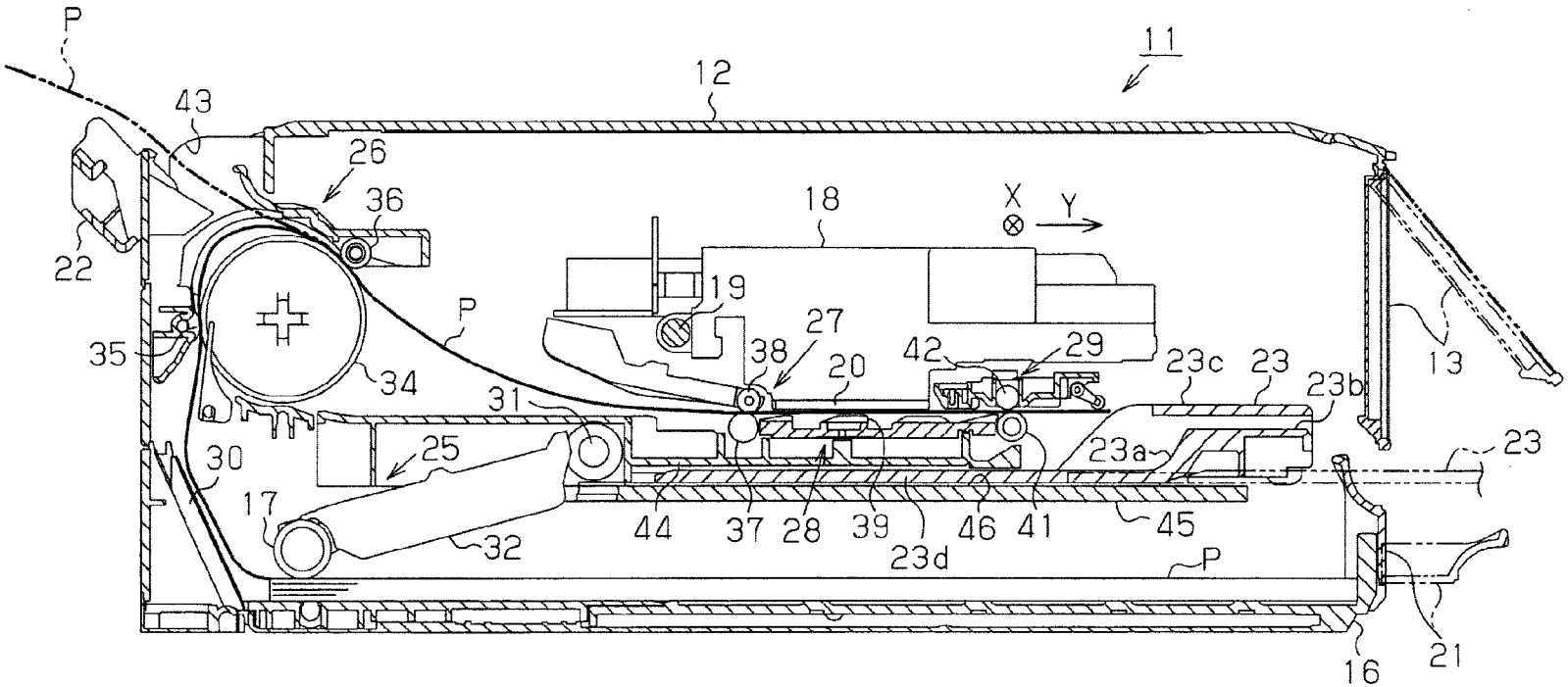
FIG. 3 is a lateral cross-sectional view of the printer.

The constituent elements on the paper conveyance route shall now be described below, with reference to FIG. 3. As illustrated in FIG. 3, the main device body 12 is provided with a cassette supply unit 25, a supply unit 26, a medium conveyance unit 27, a recording unit 28, and a feed unit 29. The cassette supply unit 25 is provided with the supply cassette 16, the pick-up roller 17 provided above the supply cassette 16, and a separation unit 30 provided to a position facing a leading end of the paper P held in the supply cassette 16.

Figure 6:
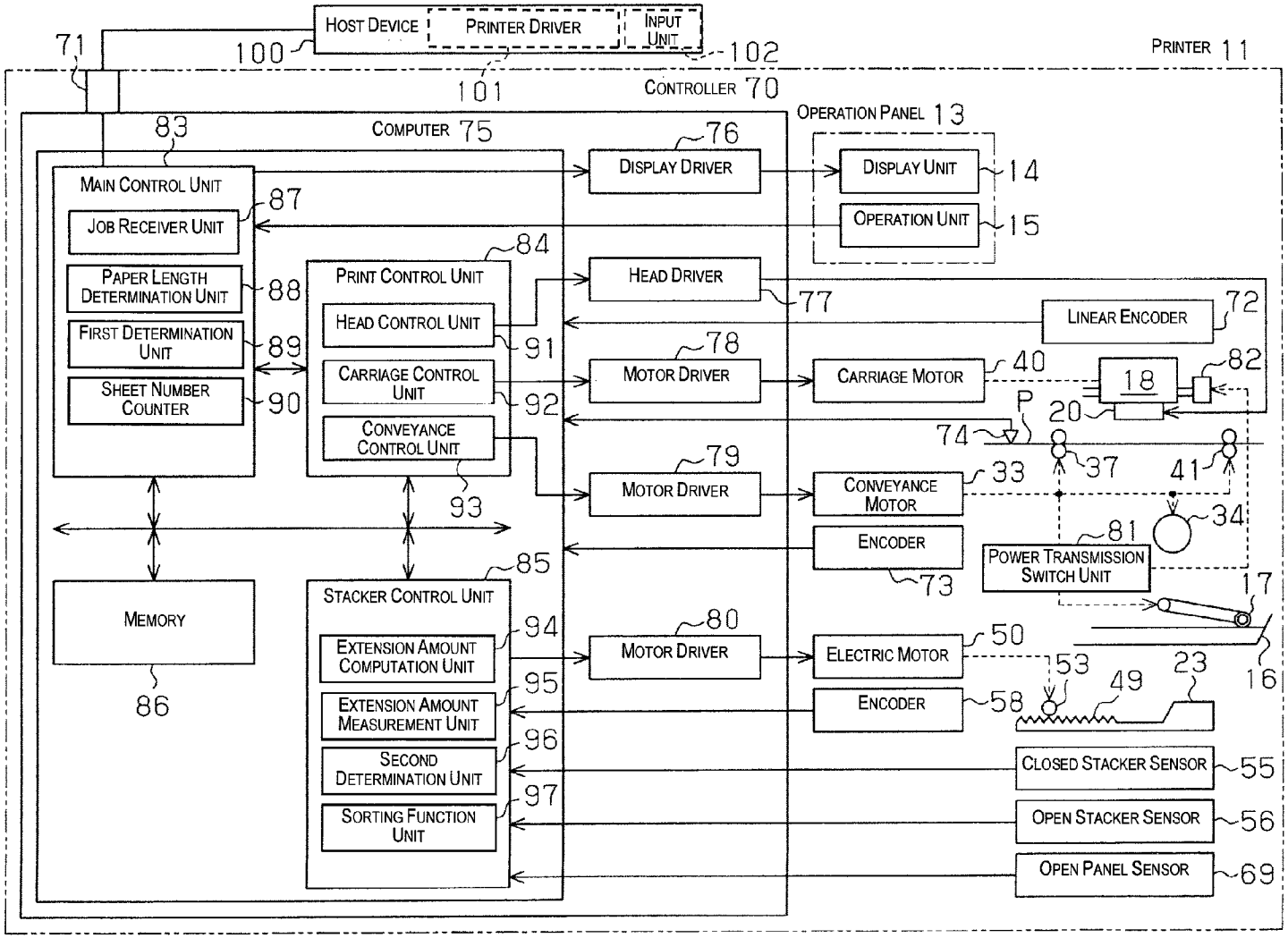
FIG. 6 is a block diagram illustrating an electrical configuration of the printer.

The pick-up roller 17 is provided to a swing member 32 that swings about a swing shaft 31, and is rotated and driven by power transmitted from a conveyance motor 33 (see FIG. 6). The pick-up roller 17 feeds the uppermost sheet of paper P out from the supply cassette 16 to a supply route, by rotating while in contact with whichever of the sheets of paper P held in the supply cassette 16 is the uppermost. At this time, the uppermost sheet of paper P being fed out from the supply cassette 16 by the rotation of the pick-up roller 17 is separated from the subsequent sheets of paper P by the separation unit 30 while en route to being fed out.

As illustrated in FIG. 3, the supply unit 26, which is provided to the downstream side of the separation unit 30 on the supply route, is provided with a supply driving roller 34, a separation roller 35, and a supplying driven roller 36, which are driven by the conveyance motor 33. The separation roller 35 is in contact with the supply driving roller 34 and again separates the paper P, and thus only the uppermost sheet of paper P is reliably fed downstream in the supply route.

The paper P, which is sandwiched between the supply driving roller 34 and the supplying driven roller 36, is conveyed to the medium conveyance unit 27. The medium conveyance unit 27 is provided with a conveying driving roller 37 which is likewise driven by the conveyance motor 33, and a conveying driven roller 38 that is driven to rotate in pressed contact with the conveying driving roller 37. The paper P is fed further downstream by the medium conveyance unit 27.

As illustrated in FIG. 3, the recording unit 28, provided to the downstream side of the medium conveyance unit 27, is provided with the carriage 18 and with a support stand 39 that faces the recording head 20. Provided to the bottom of the carriage 18 in a state of facing the paper P, the recording head 20 ejects the ink droplets onto the paper P and prints an image onto the paper P while the carriage 18 is in the process of moving reciprocatingly by the power of a carriage motor 40 (see FIG. 6) in the scan direction X (in FIG. 3, a direction orthogonal to the plane of view) while being guided by the guide shaft 19. At this time, the support stand 39 supports the paper P and prescribes the distance between the paper P and the recording head 20.

Provided to the downstream side of the support stand 39, the feed unit 29 is provided with a first roller 41 that is driven by the conveyance motor 33 and a second roller 42 that is driven to rotate by being in contact with the first roller 41. The already-recorded paper P is fed out by the feed unit 29 in a state of being nipped between the first roller 41 and the second roller 42.

The already-recorded paper P, having been fed out by the feed unit 29, is discharged to the stacker 23 provided to the front surface side of the main device body 12. The stacker 23 is provided so that the direction of sliding thereof can be switched to either a state of being drawn out along the Y direction or being drawn in to the inside of the main device body 12. The stacker 23, at least during printing, slides to protrude out in the direction going toward the outside of the main device body 12 in association with the rotating operation of the operation panel 13 in relation to the main device body 12.

In the present embodiment, a medium supply unit operating by manual insertion is provided, and the present embodiment also allows for insertion of the paper from a supply port 43 that is exposed when the cover 22 for manual insertion is in an opened state (illustrated with a two-dot chain line in FIG. 2). Paper that has been manually inserted is inserted between the supply driving roller 34 and the supplying driven roller 36 and, when the conveyance motor 33 is driven in this state, is thereby conveyed by the medium conveyance unit 27 and the feed unit 29. In other words, both supply from the supply cassette 16 and supply by manual insertion share a conveyance route that begins from a nip point between the supply driving roller 34 and the supplying driven roller 36. In the present embodiment, the supply unit 26, the medium conveyance unit 27, and the feed unit 29 constitute one example of a conveyance unit.

The stacker 23 includes: a stand unit 23*b* on which an inclined guide surface 23*a*, inclined so that a distal end section in the conveyance direction Y is increasingly higher toward the distal end, bulges upward while being formed; and a pair of raised units 23*c* that are adjacent to two sides of the stand unit 23*b* in the width direction (the same as the scan direction X) and rise higher than the stand unit 23*b*. The stacker 23 also has a base unit 23*d*, exclusive of the distal end section, that is formed in a flat, quadrangular shape (see FIG. 4). An accommodating recess 46 able to accommodate the base unit 23*d* of the stacker 23 is formed between a flat frame 44 arranged below the support stand 39 and a flat support plate unit 45 arranged therebelow and spaced apart by a predetermined interval in relation thereto. The stacker 23 is arranged at the closed position illustrated by the solid line in FIG. 3 by deep insertion of the base unit 23*d* thereof into the accommodating recess 46, and is arranged at the receiving position illustrated by the two-dot chain line in FIG. 3 by movement from the closed position in the direction of protruding out in relation to the main device body 12.

Herein, the "receiving position" refers to a position of the stacker 23 at which the amount of protrusion (amount of extension) allows for the discharged paper P to be stacked up onto the stacker 23. The "amount of extension" of the stacker 23 in the present specification refers to the amount of travel of the stacker 23 from the closed position (an amount of extension "0") toward the open position, where the amount of extension "0" is the position of the stacker 23 when at the closed position illustrated by the solid line in FIG. 3. It shall be readily understood that a reference position for the amount of extension (a position for an amount of extension "0") can be set as appropriate; for example, a position of when the distal end section of the stacker 23 arrives at the front surface of the main device body 12 (for example, a position abutting against the cover 21) can serve as the reference for the amount of extension.

As illustrated in FIG. 3, in the printer 11, the operation panel 13 when at the closed position is positioned on the movement route involved in the movement of the stacker 23 from the closed position to the open position; employing the layout of such description makes it possible to reduce the scale of the main device body 12 in the height direction. The present embodiment of such description adopts a structure whereby the sliding region of the stacker 23 and the rotation region of the operation panel 13 interfere with each other. To cause the stacker 23 to protrude out from the closed position illustrated in FIG. 3, firstly the operation panel 13 is opened and the operation panel 13 is withdrawn from the sliding region of the stacker 23, following which the stacker 23 is made to protrude. This manner whereby the operation panel 13 rotates from the closed position illustrated by the solid line in FIG. 3 to the open position illustrated by the two-dot chain line in FIG. 3 in conjunction with the protruding operation of the stacker 23 causes the operation panel 13 to be withdrawn from over the movement route of the stacker 23 and ensures the movement route for the stacker 23 toward the receiving position. Also, in the present embodiment, the amount of extension (amount of protrusion) of the stacker 23 from the main device body 12 at which the receiving position of the stacker 23 is established is not constant but rather is varied depending on the paper length of the paper P intended to be discharged.

Figure 4:
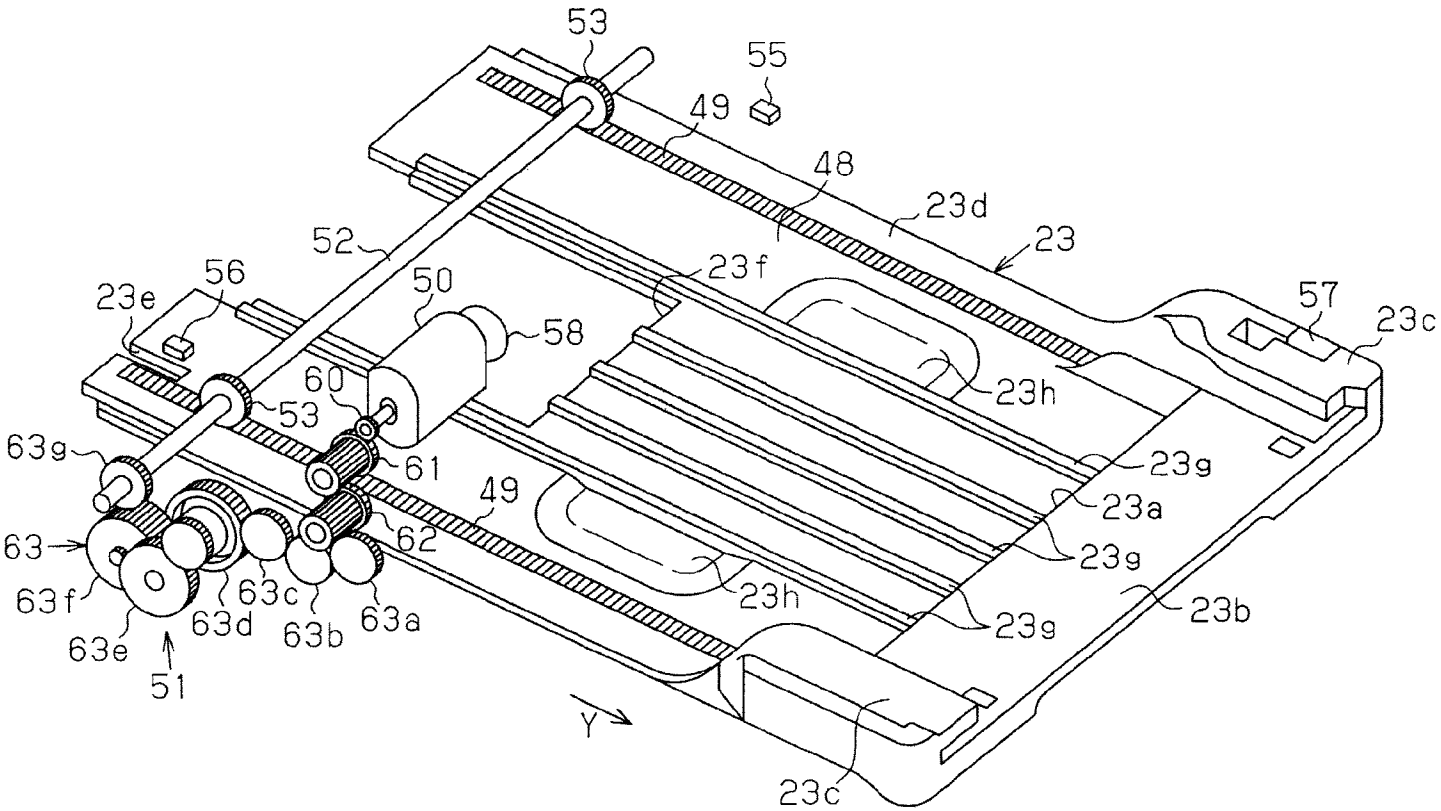
FIG. 4 is a perspective view illustrating the stacker and a drive device thereof.

The constituent elements of the stacker 23 shall now be described herein with reference to FIG. 4. The stacker 23 is provided with a medium receiving surface 48 at an upper surface of the base unit 23*d*. A pair of racks 49, 49 extending to the downstream side from the upstream side in the feed direction are provided to two end sides of the medium receiving surface 48 in the paper width direction. The racks 49, 49 mesh respectively with a pair of pinion gear wheels 53, 53 that are fitted spaced apart at a predetermined interval in the axial direction to a rotating shaft 52 constituting a power transmission mechanism 51 whereby the power of an electric motor 50, serving as one example of a power source, is transmitted.

The power transmitted from the electric motor 50 via the power transmission mechanism 51 causes the stacker 23 to move from the closed position to the open position or to move from the open position to the closed position. In the present embodiment, forward driving of the electric motor 50 causes the stacker 23 to move from the closed position in a direction of protrusion toward the open position, and reverse driving of the electric motor 50 causes the stacker 23 to move from the open position in a direction of accommodation toward the closed position.

Also provided within the main device body 12 are a closed stacker sensor 55 for detecting a state where the stacker 23 is at the closed position and an open stacker sensor 56 for detecting a state where the stacker 23 is at the open position of the greatest amount of extension. The closed stacker sensor 55 detects that the stacker 23 is at the closed position by detecting a detected unit 57 formed on an upper surface of one of the raised units 23*c* of the stacker 23. The open stacker sensor 56 detects that the stacker 23 is at the receiving position, when the amount of extension is greatest, by detecting a cut-out recess 23*e* formed in a rear end section of the stacker 23 when the stacker 23 is at the open position.

A recess 23*f* recessed toward the downstream side from the upstream side in the feed direction is formed at a widthwise middle site in a portion on the upstream side (in FIG. 4, the left side) of the base unit 23*d* in the feed direction. The recess 23*f* allows the stacker 23 to be accommodated at the closed position while avoiding the swing member 32 for supporting the pick-up roller 17 (see FIG. 3). For this reason, the stacker 23 can be inserted to a deep position within the main device body 12 when at the closed position. Accordingly, though the stacker 23 includes a single tray structure, the amount of extension needed during protrusion from the main device body 12 can be ensured.

A rotary encoder 58 for outputting a detection pulse signal having a number of pulses proportional to the amount of rotation thereof is provided to the electric motor 50. In the printer 11, the amount of extension of the stacker 23 is measured by counting with a counter the, for example, pulse edges of the detection signal coming from the rotary encoder 58, for which the origin point is when the stacker 23 is detected as being at the closed position by the closed stacker sensor 55.

A plurality of ridges 23*g* (for example, ribs) extending along the feed direction Y are formed so as to protrude out in a widthwise middle region on the medium receiving surface 48 of the stacker 23. The paper P having been discharged to the stacker 23 is placed atop the medium receiving surface 48 while sliding with the upper end surfaces of the plurality of ridges 23*g*, and therefore there will be less sliding resistance between the paper P and the medium receiving surface 48 when the paper P is being discharged onto the stacker 23. A pair of recesses 23*h* is also formed at positions on both sides of the medium receiving surface 48, between which positions the plurality of ridges 23*g* are interposed in the width direction. More specifically, the pair of recesses 23*h* are formed at positions on the medium receiving surface 48 so that the two widthwise ends of relatively narrower paper P, such as small-sized (for example, L-size or 2L-size) photographic paper and cards, having been discharged onto the medium receiving surface 48 will arrive at each of the pair of recesses 23*h*. For this reason, the two widthwise end sections of the small-sized paper P having been placed on the medium receiving surface 48 are in a state of floating from the bottom surface of the recesses 23*h*; gripping the floating portions of the paper P allows a user to relatively easily extract even the small-sized paper P from the stacker 23.

Figure 5:
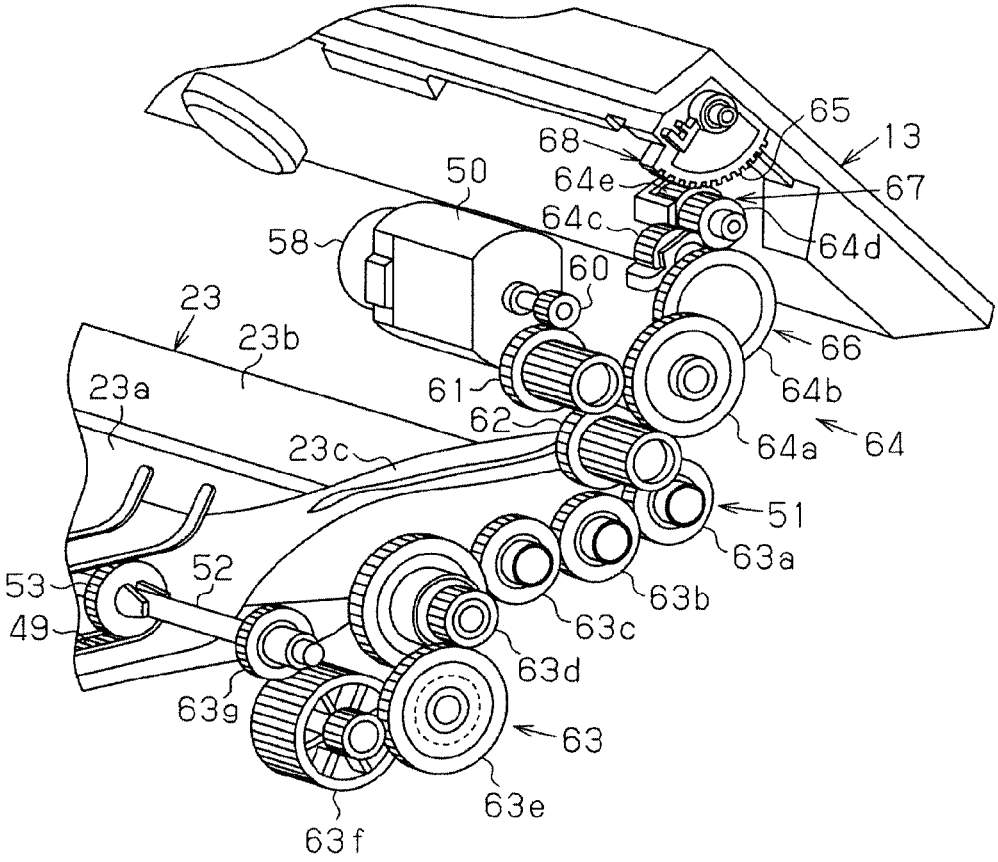
FIG. 5 is a perspective view illustrating a drive mechanism of the stacker and an operation panel.

As illustrated in FIG. 5, the power transmission mechanism 51 transmits the power coming from the electric motor 50 not only to the stacker 23 but also to the operation panel 13. That is to say, the power transmission mechanism 51 transmits the forward and reverse rotational force of the electric motor 50 to the stacker 23 as power for the stacker 23 to extend out and withdraw, and also transmits the forward rotational force of the electric motor 50 to the operation panel 13 as power for the direction of opening of the operation panel 13. Thus, in the present embodiment, the electric motor 50 constitutes also one example of an operation panel power source.

As illustrated in FIG. 5, the rotation of a gear wheel 60 fitted to the rotating shaft of the electric motor 50 is transmitted to a gear wheel 62 via a gear wheel 61. A gear train 63, which includes gear wheels 63*a* to 63*g* arranged in a state of being able to transmit the rotation of the gear wheel 62 below the gear wheel 62, serves as a route for transmitting drive power to the stacker 23. A gear train 64, which includes gear wheels 64*a* to 64*e* arranged in a state of being able to transmit the rotation of the gear wheel 62 above the gear wheel 62, serves as a route for transmitting drive power to the operation panel 13. The gear wheel 64*e* meshes with a segment gear 65 provided to the rotating shaft of the operation panel 13. The gear train 64 includes two planetary gear mechanisms 66, 67; the two planetary gear mechanisms 66, 67 have meshed engagement when the power in the direction of rotation in the direction for opening the operation panel 13 is being transmitted, and lose the meshed engagement when power in the direction of rotation opposite thereto is being transmitted. Also provided is a release mechanism 68 whereby the meshed engagement between the gear wheel 64 and the segment gear 65 is released when the operation panel 13 rotates in the direction of opening from the closed position (a standby position) and arrives at an angle of posture of the open position. An open panel sensor 69 (see FIG. 6) for detecting that the operation panel 13 is at the open position is provided to a position, in the vicinity of the rotating shaft, on an end section on the side opposite in the width direction X to an end section of the connecting side to the power transmission mechanism 51, illustrated in FIG. 5, of the operation panel 13.

For this reason, the present embodiment adopts specifications such that the operation panel 13 is rotated by the power of the electric motor 50 in the direction of opening toward the open position with an obliquely upward orientation but is not driven in the direction of closing going toward the closed position from the open position, and in a case where the operation panel 13 is to be closed, the user pushes down on the operation panel 13. The specifications as regards the stacker 23 are such that the sliding operation in the direction of protruding from the main device body 12 and the sliding operation in the direction of being stored in the main device body 12 are both carried out by the electric motor 50. The gear wheel 63*d* in the gear train 63, however, is also provided with a friction clutch mechanism whereby the power transmission surface slips and rotates idly when a rotational force in excess of a certain value is applied, thus also making it possible for a manual operation by the user to cause the stacker 23 to slide in both directions.

The electrical configuration of the printer 11 shall now be described on the basis of FIG. 6. As illustrated in FIG. 6, the printer 11 is provided with a controller 70 which governs a variety of controls. The controller 70 is connected to, so as to be able to communicate with, a host device 100 via a communication interface 71. The controller 70 controls the print operation of the printer 11 and the like on the basis of print job data received from the host device 100. The host device 100 includes, for example, a personal computer, and has a built-in printer driver 101. The host device 100 is provided with an input unit 102 including a keyboard and a mouse; operating the input unit 102 allows the user to input print condition information on a setting screen displayed by the printer driver 101 on a monitor (not shown). The print condition information includes the type of paper, the paper size, the print colors, the print quality, and the like. The printer driver 101 generates print image data of an image for which the execution of printing has been designated, on the basis of the print condition information, and attaches a header, which includes some of the print condition information, to the print image data to generate print job data, which is then sent to the printer 11. In the present example, the print condition information that is included in the header includes at least the paper type and the paper size.

Connected to the controller 70 as an output system are the display unit 14, the carriage motor 40, the conveyance motor 33, and the electric motor 50. Also connected to the controller 70 as an input system are the operation unit 15, which includes the power source switch 15*a*, and a linear encoder 72, rotary encoders 58, 73, a paper detection sensor 74, the closed stacker sensor 55, the open stacker sensor 56, and the open panel sensor 69.

As illustrated in FIG. 6, the controller 70 is provided with a computer 75, a display driver 76, a head driver 77, and motor drivers 78, 79, 80. The computer 75 drives the recording head 20 via the head driver 77 on the basis of the print job data, and renders an image or the like based on the print image data by ejecting the ink droplets. The computer 75 also drives and controls the carriage motor 40 via the motor driver 78 and controls the movement of the carriage 18 in the scan direction X. Herein, the computer 75 ascertains the movement position of the carriage 18, for which the origin point is, for example, a home position, by counting an input pulse coming from the linear encoder 72 with a counter (not shown).

The computer 75 further drives the conveyance motor 33 via the motor driver 79. Herein, a power transmission switch unit 81 (clutch unit) having a switching lever (not shown) arranged on the movement route of the carriage 18 is interposed on the power transmission route of the conveyance motor 33. Driving by a predetermined amount of rotation of the conveyance motor 33 in a state where the carriage 18 presses on the switching lever switches the power transmission switch unit 81 to a switch position corresponding to the rotational position thereof. The conveyance motor 33 is connected at all times to the conveying driving roller 37 and the first roller 41. At two of the switch positions among the plurality of switch positions of the power transmission switch unit 81, the conveyance motor 33 is connected to the pick-up roller 17 and to a gap adjustment unit 82, respectively.

The gap adjustment unit 82 adjusts the gap (interval) between the recording head 20 and the support stand 39 by moving the carriage 18 in the height direction. The gap adjustment unit 82 adjusts the height position of the carriage 18 so that the gap corresponds to the paper thickness ascertained from the paper type information.

Also, as illustrated in FIG. 6, the computer 75 drives the electric motor 50 via the motor driver 80. When the electric motor 50 is driven forward, the pinion gear wheels 53 turn forward, and the stacker 23 moves in the direction of protrusion via the meshed engagement between the forward rotating pinion gear wheels 53 and the racks 49. When the electric motor 50 is driven in reverse, in turn, the pinion gear wheels 53 turn in reverse, and the stacker 23 moves in the direction of being stored in the main device body 12 via the meshed engagement between the reverse rotating pinion gear wheels 53 and the racks 49.

The closed stacker sensor 55 is on in the state where the stacker 23 is at the closed position, and is off in the state where the stacker 23 is not at the closed position. The open stacker sensor 56 is on in the state where the stacker 23 is at the open position, where the amount of extension is greatest, and is off when the stacker 23 is not at the open position where the amount of extension is greatest. The encoder 58 outputs to the computer 75 a detection pulse signal having a number of pulses proportional to the amount of rotation of the electric motor 50.

The computer 75 illustrated in FIG. 6 is configured to be provided with, for example, a central processing unit (CPU), an application specific integrated circuit (ASIC), a random access memory (RAM), read-only memory (ROM), a non-volatile memory, and the like. The ROM or non-volatile memory stores a variety of programs, including a program for controlling the stacker illustrated by the flow chart in FIG. 8. The computer 75 is provided with a plurality of functional units, illustrated in FIG. 6, which include software constructed by when the CPU executes the programs stored in the ROM or non-volatile memory. That is to say, the computer 75 is provided with a main control unit 83, a print control unit 84, a stacker control unit 85, and a memory 86, as the plurality of functional units. It shall be readily understood that there is no limitation to the configuration of software using the computer 75, and the configuration can be one of hardware, such as an electronic circuit (for example, a custom IC), or the configuration can be one of software and hardware in collaboration.

As illustrated in FIG. 6, the main control unit 83 is provided with a job receiver unit 87, a paper length determination unit 89 serving as one example of a determination unit, a first determination unit 89, and a sheet number counter 90. The job receiver unit 87 either receives the print job data coming from the host device 100, or receives print job data for printing image data inputted to the printer 11 from a portable memory device such as a memory card or USB memory connected to the printer 11. The print job data includes information on the paper size. It shall be readily understood that information on the paper length can be used instead of the information on the paper size.

The paper length determination unit 88 determines the paper length from the information on the paper size. In other words, the paper length determination unit determines a paper length corresponding to the paper size on the basis of the information on the paper size within the print condition information. In a case where the print job data includes the information on the paper length, then the information on the paper length is acquired without alteration.

The first determination unit 89 determines a timing for starting to drive the stacker 23 in the direction of opening (the direction of protrusion (the Y direction)) after receipt of the print job data. The sheet number counter 90 counts the number of sheets (number of printed sheets) of the paper P having been printed on and discharged. The sheet number counter 90 is reset every time the position of the stacker 23 changes. For this reason, the sheet number counter 90 counts the number of sheets of paper that have been placed (stacked) onto the same position on the stacker 23.

The print control unit 84, illustrated in FIG. 6, is provided with a head control unit 91, a carriage control unit 92, and a conveyance control unit 93. The head control unit 91 controls the recording head 20 via the head driver 77 on the basis of the print image data received from the main control unit 83, and carries out a control for causing the recording head 20 to eject the ink droplets.

The carriage control unit 92 controls the carriage motor 40 via the motor driver 78, and controls the driving of the carriage 18 in the scan direction X. The carriage motor 40 is also driven in order to switch the power transmission switch unit 81 for transmitting the power of the conveyance motor 33 to the gap adjustment unit 82 when adjustments are to be made to the gap corresponding to the paper thickness as ascertained from the paper type information, as a print preparation operation prior to the start of printing by the printer 11.

The conveyance control unit 93 controls the conveyance motor 33 via the motor driver 79, and controls the supplying and conveying of the paper. The conveyance motor 33 is also driven in order to drive the gap adjustment unit 82 after switching of the power transmission switch unit 81 by the carriage 18 also during gap adjustment corresponding to the paper thickness as a print preparation operation of the printer 11.

The stacker control unit 85 illustrated in FIG. 6 is provided with an extension amount computation unit 94, an extension amount measurement unit 95, a second determination unit 96, and a sorting function unit 97. The extension amount computation unit 94 acquires the information on the paper length determined by the paper length determination unit 88, and computes an amount of extension serving as a target for the stacker 23 in accordance with the paper length.

The extension amount measurement unit measures the current amount of extension of the stacker 23. The extension amount measurement unit 95 receives, inputted from the encoder 58, the detection pulse signal having a number of pulses proportional to the amount of rotation of the electric motor 50. The extension amount measurement unit 95 is provided with a counter (not shown) for counting the pulse edges of the detection pulse signal, the origin point for which is when the closed stacker sensor 55 has detected that the stacker 23 is at the closed position. More specifically, the phases of two signals of different phases included in the detection pulse signal are compared to detect the direction of rotation of the electric motor 50, i.e., the direction of movement of the stacker 23. When the direction of movement of the stacker 23 is the direction of protrusion, then the counter is incremented, whereas when the direction of movement of the stacker 23 is the direction of accommodation, then the counter is decremented. In this manner, the extension amount measurement unit 95 measures the actual amount of extension of the stacker 23 by carrying out this counting processing of the counter. In the present embodiment, in which both the operation panel 13 and the stacker 23 are driven by a shared power source, the stacker control unit 85 also carries out a control for rotating the operation panel 13 toward the open position when not at the open position by driving the electric motor 50.

The second determination unit 96 carries out a variety of determinations relating to the stacker control. The second determination unit 96 of the present embodiment uses, for example, a target extension amount computed by the extension amount computation unit 94 as well as the actual amount of extension measured by the extension amount measurement unit 95 to determine whether or not the current amount of stacker extension is an amount of stack extension corresponding to the paper length.

The memory 86 either includes, for example, a RAM or a non-volatile memory, or is constituted of both. The memory 86 stores reference data needed for each of the control units 83 to 85 to carry out the variety of controls. The memory 86 also stores computation results given by each of the control units 83 to 85, flags for state management, and the like.

In the printer 11 of the present embodiment, after the print job data has been received and printing has been started, the operation panel 13 is driven and the stacker 23 is driven both on the basis of the power of the electric motor 50. Also, in the printer 11 of the present embodiment, the position of the stacker 23 is controlled so that the amount of stacker extension corresponds to the paper length.

Further, in the printer 11, in a case where paper of a relatively smaller paper size is being stacked onto different positions on the stacker 23, then the position of the stacker 23 is controlled so that the paper is stacked a plurality of sheets at a time at the different positions on the stacker 23. In the printer 11, the position of the stacker 23 is also controlled so that the paper is stacked in a state of having been sorted on the stacker 23.

The actions of the printer 11 configured as described above shall now be described. Firstly, the control for operating the operation panel 13 and operating the stacker 23 after the start of printing shall be described using the operation pattern in FIG. 7 and the flow chart illustrated in FIG. 8.

Figure 7A:
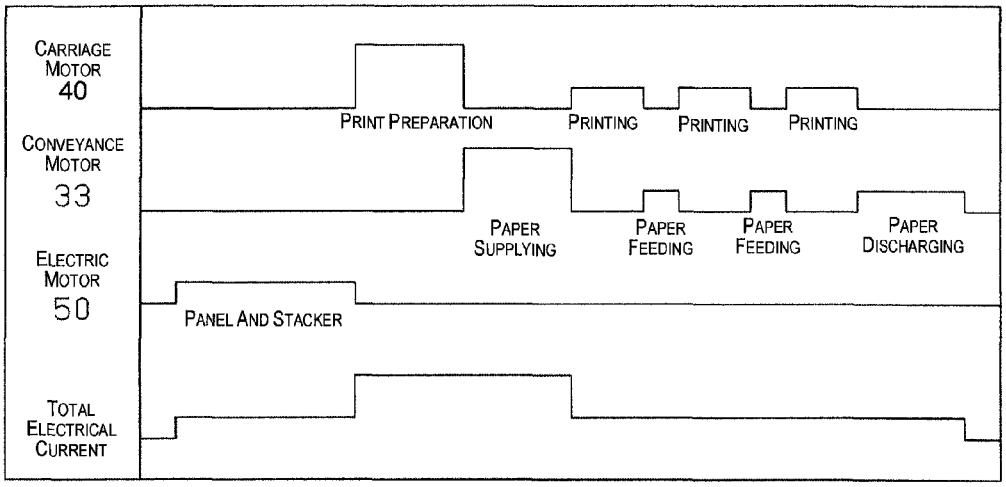
FIG. 7A is a timing chart illustrating an operation pattern of a comparative example.

Also, in the printer 11 of the present embodiment, the position of the stacker 23 is controlled so that the amount of extension corresponds to the paper length. A comparative example illustrated in FIG. 7A illustrates an operation pattern of a case where the panel is operated and the stacker is operated prior to the start of printing. In FIG. 7, the horizontal axis is time and the vertical axis is the electrical current value; the operation pattern illustrates the manner in which each of the motors 33, 40, and 50 is driven. As illustrated in FIG. 7A, the example is one where printing is started after the stacker 23 has been made to protrude out and preparations to receive the paper have been made. In the comparative example, a standby time until the operation to protrude the stacker 23 is completed takes place at the start of printing, and this standby time is a cause for a diminished printing throughput.

Figure 7B:
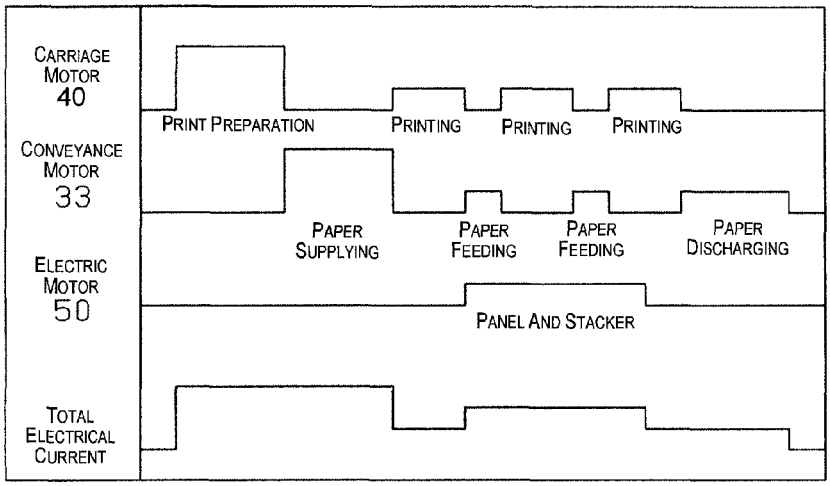
FIG. 7B is a timing chart illustrating an operation pattern of the present embodiment.

For this reason, in the present embodiment, as illustrated in FIG. 7B, the panel operation and the stack operation (hereinafter also "the panel and stacker operation") are carried out after the start of printing. Also, the panel and stacker operation are carried out after a print preparation operation and a paper feed operation have been completed, as illustrated in FIGS. 7A and 7B. This is in order to avoid a situation where the motor has a power shortage and the target speed can not longer be obtained or where the power source device or the like is modified to one that is larger and more expensive because of the allowable power, which situation would be caused by an increase in the maximum electrical current value when the panel and stacker operation is carried out at a timing that overlaps with the print preparation operation and the paper feed operation, given the comparatively higher motor current values needed for these operations.

The print control carried out in the operation pattern of the present embodiment illustrated in FIG. 7B shall now be described, on the basis of the flow chart in FIG. 8. First, in step S1, the print preparation operation is carried out. As one form of print preparation operation, the gap adjustment operation for adjusting to a gap that corresponds to the paper thickness of the paper P is carried out. In order to carry out the gap adjustment, the carriage motor 40 is driven and the power transmission switch unit 81 is switched by the operation of the carriage 18; thereafter, the conveyance motor 33 is driven by a small amount commensurate with the amount of rotation needed for the adjustment, thereby driving the gap adjustment unit 82. When the gap adjustment operation is completed, the carriage motor 40 is driven and the power transmission switch unit 81 is switched by the operation of the carriage 18 to the switch position for the next operation (in the present example, the paper feed operation). In the print preparation operation, a predetermined amount of force or greater is needed to switch the power transmission switch unit 81, and therefore the electrical current value of the carriage motor 40 will be comparatively higher (see FIG. 7B). FIG. 7 omits an illustration of the driving of the conveyance motor 33 in the print preparation operation, but the amount by which the conveyance motor 33 is driven at this time is rather small, and the driving moreover does not conflict with the drive timing for the carriage motor 40, and thus there is no change to total electrical current value during the print preparation operation.

In step S2, the paper feed operation is carried out. That is to say, the conveyance motor 33 is driven by an amount of electrical current for paper feeding. As a result, the one uppermost sheet of paper P is fed out from the supply cassette 16 by the driving of the pick-up roller 17, and the paper P having been fed out is conveyed to a print start position on a paper feed route that passes through the outer periphery of the supply driving roller 34.

In step S3, a determination is made as to whether or not the timing for driving the panel and stacker is in effect. This determination is carried out by the first determination unit 89 of the main control unit 83. The timing for driving the panel and stacker is set to a predetermined timing after the completion of the paper feed operation. The predetermined timing is at such a time as to allow the stacker 23 to catch the discharged paper P even in a case where the time needed to print one sheet is a comparatively short period of time. In the present example, the drive timing is set to between after the timing immediately after the paper feed operation to a timing after completion of a plurality of passes of printing (for example, five passes) by the carriage 18. As one example, in FIG. 7B, the timing for driving the panel and stacker is set to when one pass of printing is completed, i.e., to when the first paper feeding is started. When this set drive timing is reached (an affirmative determination in S3), the flow proceeds to step S4; in a case where the drive timing has not been reached (a negative determination in S3), the flow proceeds to step S8.

In a case where the timing for driving the panel and stacker has not been reached, the print operation is carried out in step S8. The print operation includes one pass worth of printing, carried out by one iteration of moving the carriage 18 in the scan direction X, and also paper feeding in which the paper P is conveyed to the next print position after the completion after this one pass worth of printing. Then, in the next step S9, a determination is made as to whether or not the printing of one sheet has been completed; when the printing of one sheet has not yet been completed, the flow returns to step S3.

Figure 8:
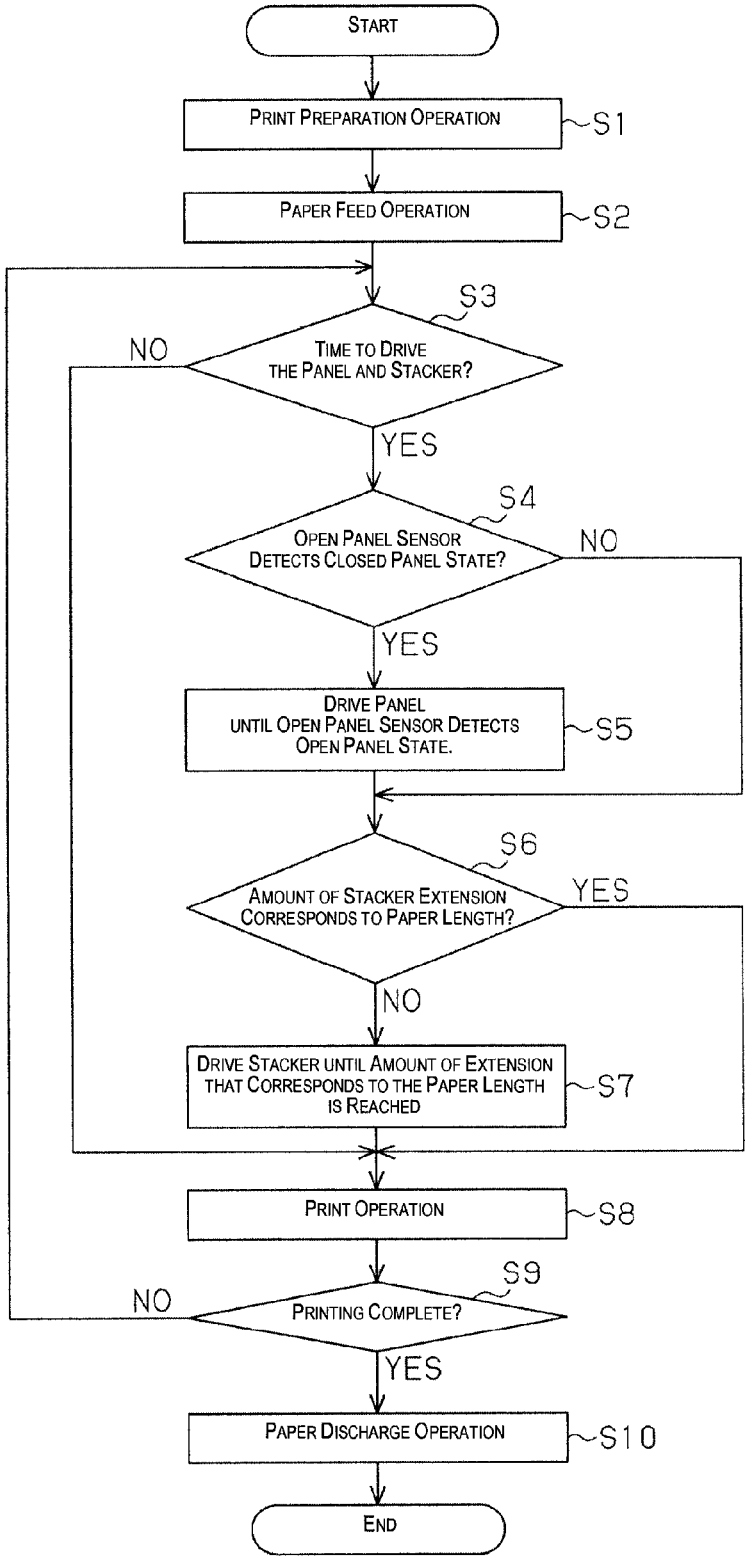
FIG. 8 is a flow chart illustrating a print control associated with a stacker control.

In the example in FIG. 8, a determination is made as to whether or not the timing for driving the panel and stacker is in effect is made at every timing where both the one pass worth of printing and the paper feeding are ended, but the determination for the drive timing can also be carried out for every one pass of printing and for every paper feeding, or the determination for the drive timing can be carried out at predetermined intervals (for example, a predetermined value within the range of several tens of microseconds to several hundreds of milliseconds). The configuration can also be such that a monitoring unit monitors the drive timing, and the processing for steps S4 to S7 is executed by interrupt processing whenever the drive timing is reached.

Then, printing on the paper P proceeds while the determination of step S3 is carried out for every predetermined timing during the printing of one sheet of the paper P. The flow proceeds to step S4 when the set timing for driving the panel and stacker is reached not long after the start of printing (an affirmative determination in S3). Then, the driving of the panel and stacker is carried out in the process for steps S4 to S7.

Firstly, in step S4, a determination is made as to whether or not the open panel sensor 69 has detected the closed panel state. The flow proceeds to step S5 when the open panel sensor 69 has detected the closed panel state. When the open panel sensor 69 is not in a closed panel state, i.e., when the operation panel 13 is already at the open position, then the flow proceeds to step S6.

In step S5, the operation panel 13 is driven until the open panel sensor 69 detects the open panel state. That is to say, the stacker control unit 85 drives the electric motor 50 in the forward direction to cause the operation panel 13 to rotate in the direction of the open position; when the open panel sensor 69 detects the open panel state, the driving of the electric motor 50 is stopped. When the operation panel 13 reaches the angle of posture of the open position, the function of the release mechanism 68 releases the meshed engagement between the gear wheel 64*e* and the segment gear 65, following which the operation panel 13 is retained at the open position even when the electric motor 50 is driven.

In step S6, a determination is made as to whether or not the amount of extension corresponds to the paper length. This determination is carried out by the second determination unit 69 using a computation result of the extension amount computation unit 94 and a measurement result of the extension amount measurement unit 95. More specifically, the paper length determination unit 88 determines the paper length using the paper size information included in the header of the print job data received by the job receiver unit 87, and the stacker control unit 85 acquires the information on the paper length thus determined from the main control unit 83. The extension amount computation unit 94 computes the amount of extension of the stacker 23 corresponding to the paper length thereof on the basis of the information on the paper length.

Herein, the "amount of extension corresponding to the paper length" refers to the fact that a longer paper length correlates to a greater amount of extension of the stacker 23. In particular in the present example, the amount of extension is a value where the paper P is supported on the stacker 23 in a region not less than half the paper length thereof so as to prevent the paper P from falling off from the stacker 23, and where the amount whereby the stacker 23 projects beyond the leading end of the paper is not excessive. For example, the amount of extension of the stacker 23 is set so that the amount of extension whereby the sheet of paper P projects beyond the distal end of the stacker 23 (hereinafter also called the "paper extension amount") is kept within a range less than half the length of the paper in the direction of discharging, and also so that surfeit region of the stacker 23, which is further in the direction of discharge than the leading end of the paper P, is kept to less than whichever value is shorter from among half the length of the paper in the direction of discharge and 5 cm. As one example, the amount of extension of the stacker 23 is set so that the leading end of the paper P and the distal end of the stacker 23 are matched to each other. The amount of extension that satisfies the condition thus set is computed by the extension amount computation unit 94. Also, the count value of the counter of the extension amount measurement unit 95 is read out, and the actual current amount of extension of the stacker 23 is acquired from the count value. The determination as to whether or not the amount of extension of the stacker corresponds to the paper length is carried out in step S6 by determining whether or not the actual amount of extension measured by the extension amount measurement unit 95 matches the target amount of extension computed by the extension amount computation unit 94. The flow proceeds to step S8 when the amount of extension of the stacker corresponds to the paper length, and proceeds to step S7 when the amount of extension does not correspond to the paper length.

In step S7, the stacker 23 is driven until the amount of extension corresponds to the paper length. That is to say, in a case where the actual amount of extension is less than the target amount of extension, the stacker control unit 85 drives the stacker 23 in the direction of protrusion by driving the electric motor 50 forward; when the count value of the extension amount measurement unit 95 reaches a value equivalent to the target amount of extension, then the driving of the electric motor 50 is stopped. In a case where the actual amount of extension is greater than the target amount of extension, the stacker control unit 85 drives the stacker 23 in the direction of accommodation by driving the electric motor 50 in reverse; when the count value of the extension amount measurement unit 95 reaches a value equivalent to the target amount of extension, then the driving of the electric motor 50 is stopped. In this manner, the stacker 23 carries out position adjustments to an amount of extension corresponding to the paper length.

At this time, as regards the relationship where the driving of the operation panel 13 to the open state and the driving of the stacker 23 to the target amount of extension corresponding to the paper length are both carried out by the shared electric motor 50, the configuration can be such that priority is given to carrying out whichever driving of the two involves less driving by the electric motor 50. Such a configuration removes the need for the surfeit positional control of returning the stacker 23 in the direction of accommodation for extension amount adjustment after the operation panel 13 has reached the open state.

The processing for steps S3 to S7, i.e., the control of the panel and stacker driving, is carried out by interrupt processing during the print operation; the print operation proceeds concurrently even during the control of the panel and stacker driving. The panel and stacker driving is implemented not long after the printing operation is started, and the stacker 23 is adjusted to the amount of extension corresponding to the paper length shortly after the printing operation is started.

Once the drive timing has been reached and the stacker 23 is driven, then the drive timing has been passed in the printing of that page, and therefore the drive timing is determined not to be in effect in step S3. Then, when the printing of that page is completed (an affirmative determination in S9), then the flow proceeds to step S10, in which a paper discharge operation is carried out. That is to say, the conveyance control unit 93 discharges the paper by driving the conveyance motor 33 and rotatingly driving each of the rollers 34, 37, 41, and the like. As a result, the already-printed paper P is discharged onto the stacker 23. At this time, the amount of extension of the stacker 23 corresponds to the paper length, and thus, for example, the paper P is discharged in a state where the leading end thereof substantially matches the distal end of the stacker 23.

According to the first embodiment described above, it is possible to obtain the following effects.

(1) The stacker 23 is moved to the receiving position at which the amount of extension corresponds to the paper length, and thus the paper is more readily removed from the stacker 23. Also, the stacker 23 does not protrude more than is necessary, and thus the stacker 23 is also less obtrusive even when protruding.

(2) The configuration is such that the panel and stacker driving is carried out concurrently with the printing after the start of printing, and thus it is possible to start printing earlier and improve the printing throughput. When, for example, the panel and stacker driving is carried out prior to the start of printing, as per the comparative example (FIG. 7A), then a standby time waiting for the completion thereof occurs and the print start timing is delayed, causing a decline in the print throughput. However, according to the present embodiment, this type of standby time does not occur, and thus the print throughput is improved in comparison to the comparative example.

(3) The timing for a print preparation operation and paper feed operation which would require in particular a relatively higher electrical current value is avoided, and the panel and stacker driving is carried out amidst the printing after the completion of these operations. For this reason, for example, an insufficiency of power for the motors 33, 40, and 50 is avoided and the necessary power is ensured, and thus the motors 33, 40, and 50 can be driven at the target speeds.

(4) The operation panel 13 opens from the closed position to the open position in conjunction with the movement of the stacker 23 from the closed position to the open position in the direction of protrusion (direction of opening), and thus the stacker 23 can be moved to a position corresponding to the paper length without the operation panel 13 interrupting the course of the stacker 23. For this reason, employing a layout where the operation panel 13 of the closed position is arranged on the movement route of the stacker 23 makes it possible to make the printer 11 thinner. Also, the movement route of the stacker 23 can still be ensured even with this layout achieving a thinner printer 11.

(5) The stacker 23 is a single stage, which is a single-tray structure, and thus smoother movement to the position of the target amount of extension is possible in comparison to the multi-stage stacker disclosed in patent document 1.

(6) The proximal end section of the stacker 23 has the recess 23*f* formed at a location corresponding to the swing member 32. For this reason, the stacker 23 can be deeply inserted into the main device body 12 in the direction opposite to the conveyance direction Y without interfering with the other members, such as the swing member 32 of the pick-up roller 17. For this reason, the requisite length can be ensured even with a single stacker 23, and the stacker 23 can be smooth extended out.

(7) The plurality of ridges 23*g* are formed on the medium receiving surface 48 of the stacker 23 so as to extend along the feed direction Y, and thus the sliding resistance between the paper P and the medium receiving surface 48 can be reduced and the paper P can be smoothly discharged onto the stacker 23 without catching or the like. Also, the pair of recesses 23*h* is formed in the medium receiving surface 48, and thus both widthwise end sections of small-sized paper P, such as photographic paper or cards, having been placed on the medium receiving surface 48, float from the bottom surface of the recesses 23*h*; by grasping the floating portion thereof, the user is able to relatively easily remove even small-sized paper P from the stacker 23.

Second Embodiment

Figures 9, 10:
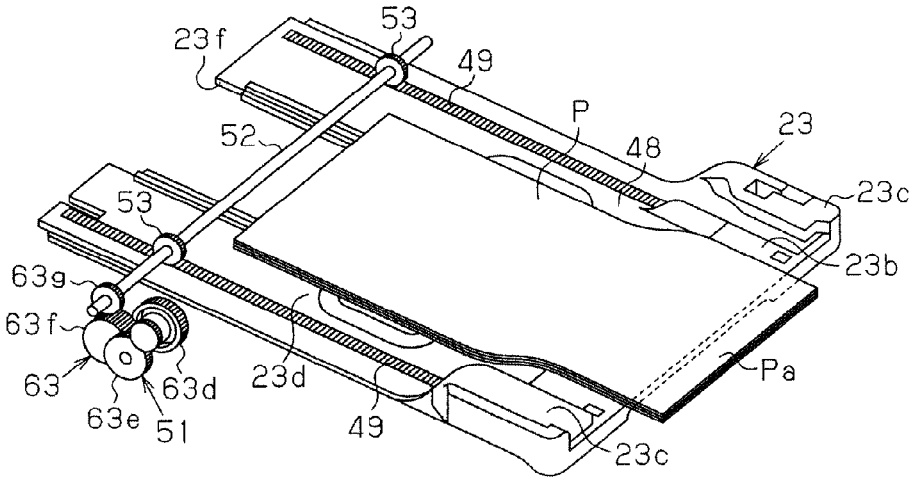
FIG. 9 is a perspective view of the stacker, for describing a stacker control in a second embodiment.
FIG. 10 is a schematic view illustrating stacker state data.

The second embodiment shall be described next, on the basis of FIGS. 9 to 11. This embodiment is an example where the amount of extension of the stacker 23 that corresponds to the paper length is set so that the leading end section Pa of the paper P projects somewhat out beyond the distal end section of the stacker 23 in the direction of protrusion, as illustrated in FIG. 9. Configurations similar to those of the first embodiment have been omitted from this description, and are given like reference numerals in the description.

The mechanical configuration (FIGS. 1 to 5) and electrical configuration (FIG. 6) of the printer 11 is similar to that of the first embodiment. A non-volatile memory of the computer 75 stores a program illustrated by the flow chart in FIG. 11. The memory 86 also stores stacker state data D1, illustrated in FIG. 10, which is used in order to acquire the positional state of the stacker 23 from each of the signal levels of the closed stacker sensor 55 and the open stacker sensor 56. The computer 75 refers to the stacker state data D1 illustrated in FIG. 10 and ascertains three states, namely, an open stacker state where the stacker 23 is at the open position, a half-open stacker state where the stacker 23 is positioned in an intermediate region between the open position and the closed position, and a closed stacker state where the stacker 23 is at the closed position, from a combination of the signal levels of each of the detection signals of the sensors 55, 56. In the present specification, in some instances the two sensors 55, 56 are simply called "stacker sensors".

Figure 11:
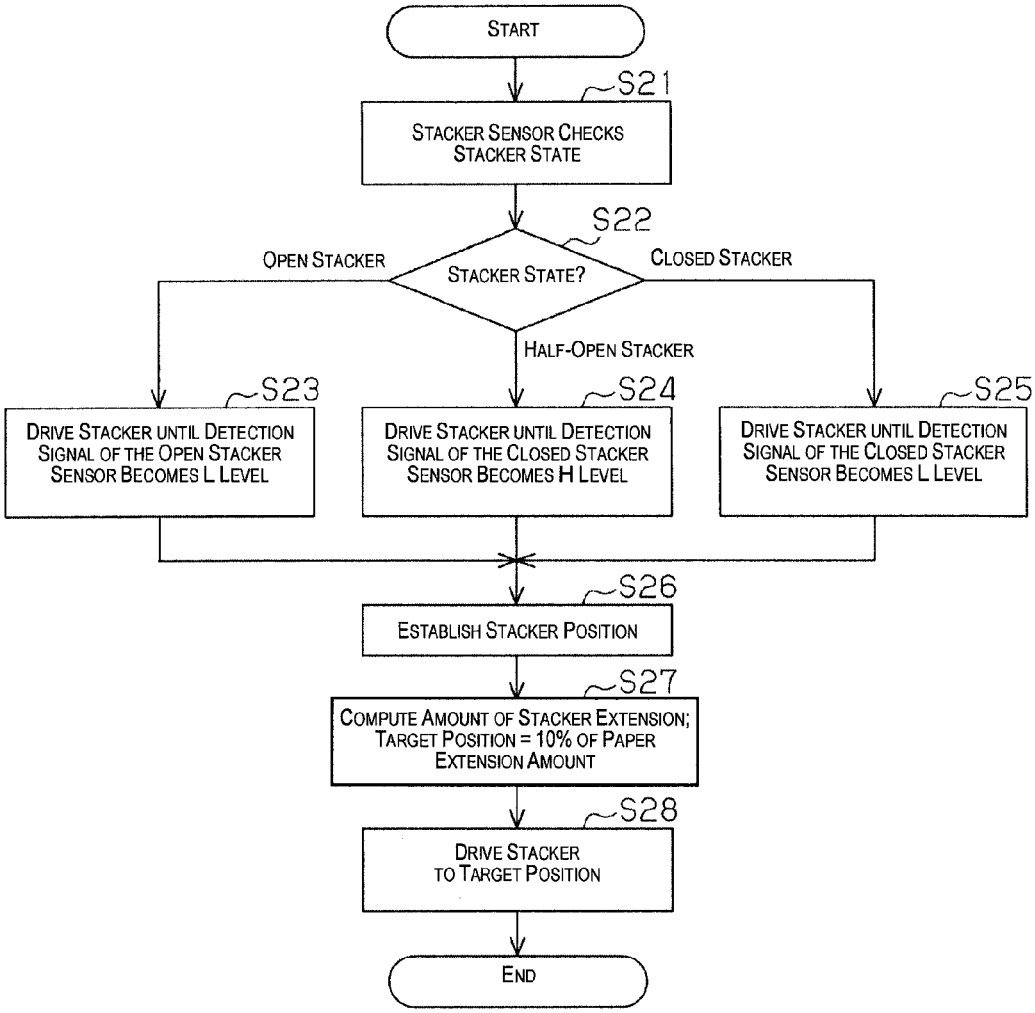
FIG. 11 is a flow chart illustrating the stacker control.

The following describes the stacker control in the printer 11 of the present embodiment, on the basis of FIG. 11. Firstly, in step S21, the state of the stacker according to the stacker sensors is checked. This check of the state is carried out by the second determination unit 96. The second determination unit 96 acquires the signal levels of the detection signals of each of the stacker sensors 55, 56, refers to the stacker state data D1 illustrated in FIG. 10 stored in the memory 86, and checks the state of the stacker 23 corresponding to the signal levels at the time. The open stacker state is confirmed to be in effect when the combination of the signal level of the closed stacker sensor 55 and the signal level of the open stacker sensor 56 is (L, H); the half-open stacker state is confirmed to be in effect when the combination is (L, L); and the closed stacker state is confirmed to be in effect when the combination is (H, L).

In step S22, the stacker state is determined, and when the open stacker state is in effect, the flow proceeds to step S23; when the half-open stacker state is in effect, the flow proceeds to step S24; and when the closed stacker state is in effect, the flow proceeds to step S25.

In step S23, the stacker 23 is driven until the detection signal of the open stacker sensor 56 reaches the L level. This driving stops the stacker 23 at a position where the level of the detection signal of the open stacker sensor 56 is switched from H to L.

In step S24, the stacker 23 is driven until the detection signal of the closed stacker sensor 55 reaches the H level. This driving stops the stacker 23 at a position where the level of the detection signal of the closed stacker sensor 55 is switched from L to H.

In step S25, the stacker 23 is driven until the detection signal of the closed stack sensor 55 reaches the L level. This driving stops the stacker 23 at a position where the level of the detection signal of the closed stacker sensor 55 is switched from H to L.

In step S26, the position of the stacker 23 is established. Herein, the positions at which the stacker sensors 55, 56 are switched between the L level and the H level are already known for both stacker sensors 55, 56, and are stored in the memory 86; the current position of the stacker 23 is acquired by referring to the data in the memory 86. In the present example, the count value of the counter of the extension amount measurement unit 95 is updated to the value that corresponds to the current position thus acquired.

In step S27, the amount of extension of the stacker 23 is computed. This computation is carried out by the extension amount computation unit 94. In the present embodiment, the amount of extension of the stacker 23 is set in accordance with the paper length, and is determined so that the leading end section of the paper P projects somewhat out beyond the distal end of the stacker 23 in the direction of protrusion. Herein, the amount whereby the leading end section of the paper P projects out in the conveyance direction Y beyond the distal end of the stacker 23 in the direction of protrusion is defined as being the "paper extension amount". The extension amount computation unit 94 of the present example computes the amount of extension of the stacker 23 at which the paper extension amount would be 10% of the paper length. For example, in the first embodiment, the amount of extension of the stacker 23 was computed so that the leading end of the paper P and the distal end of the stacker 23 would substantially match each other, but in the present embodiment, a value obtained by subtracting the paper length×0.1 from this amount of extension Sc is computed as being the amount of extension. By establishing the amount of extension of the stacker 23, a target position for the stacker 23 is determined.

In step S28, the stacker 23 is driven to the target position. That is to say, the stacker control unit 85 drives the electric motor 50 in a direction of driving where the stacker 23 is oriented toward the target position from the current position; when the amount of extension measured by the extension amount measurement unit 95 reaches the target amount of extension, then the driving of the electric motor 50 is stopped.

Then, the paper P is stacked onto the stacker 23 having been adjusted to the amount of extension of such description in a state where the leading end section, corresponding to 10% of the paper length, projects out beyond the distal end section of the stacker 23 in the direction of protrusion, as illustrated in FIG. 9.

According to the second embodiment described above, it is possible to obtain the following effects.

(8) The paper P is stacked onto the stacker 23 in a state where the leading end section of the paper P projects out beyond the distal end section of the stacker 23, and thus the user can more readily remove the paper P from the stacker 23 by gripping the leading end section of the paper P.

(9) The stacker 23 is driven in accordance with the stacker state, and the stacker 23 is arranged at positions where the levels of the detection signals of the sensors 55, 56 are switched between L and H; the position of the stacker 23 prior to the extension amount adjustment (the current position) is established by updating the count value of the counter of the extension amount measurement unit 95. Then, the stacker 23 is driven from the current position thus updated, so as to reach the computed amount of extension of the stacker 23, and thus the stacker 23 can be arranged at a relatively precise amount of extension. As a result, the length of the leading end section Pa of the paper P projecting out beyond the distal end section of the stacker 23 is substantially constant for every paper length, and any variance therein can be kept to a minimum. For this reason, the already-printed paper P can be more readily removed from the stacker 23 at any time.

Third Embodiment

Figure 14:
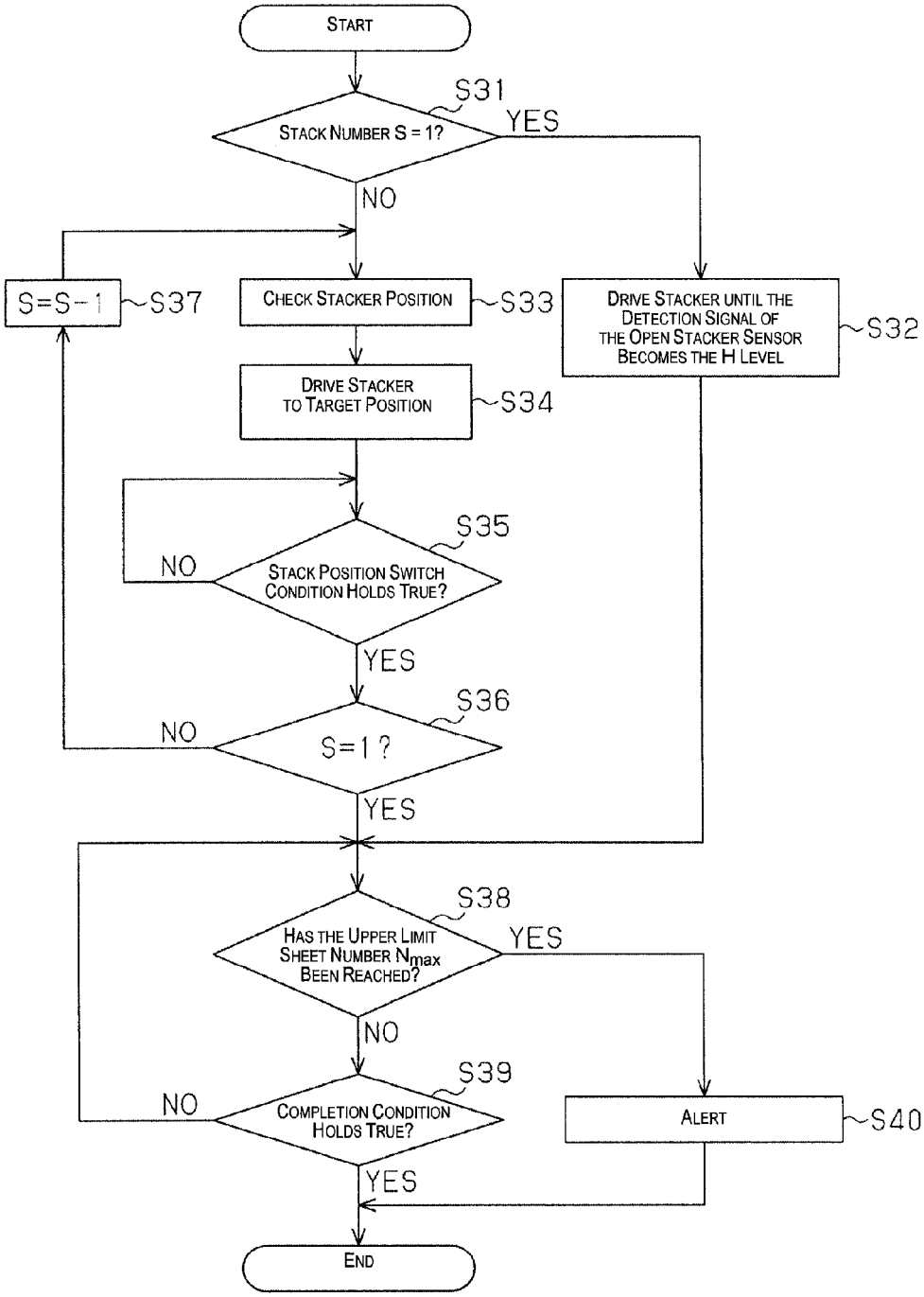
FIG. 14 is a flow chart illustrating the stacker control.

The third embodiment shall now be described, on the basis of FIGS. 12 to 14. This embodiment is an example where the stacker 23 is switched to the receiving position for a plurality of amounts of extension corresponding to the paper length, and the paper is separately stacked at a plurality of stacking positions (stack positions) of different positions in the conveyance direction Y on the stacker 23. Configurations similar to those of the first embodiment have been omitted from this description, and are given like reference numerals in the description.

The mechanical configuration (FIGS. 1 to 5) and electrical configuration (FIG. 6) of the printer 11 is similar to that of the first embodiment. The non-volatile memory of the computer 75 stores a program illustrated by the flow chart in FIG. 14. The memory 86 also stores stack data D2 illustrated in FIG. 13. As illustrated in FIG. 13, a stack number S indicative of the number of stacking positions, an upper limit sheet number Nmax for the paper P that can be stacked at one stack position, and an upper limit total sheet number Nt indicative of an upper limit for the total number of sheets of paper that can be stacked on the stacker 23 are set for every paper length L in the stack data D2 (Nt=S×Nmax). The stack data D2 in FIG. 13 is indicative of an example of one paper type; the upper limit sheet number Nmax and the upper limit total sheet number Nt vary depending on the paper thickness Tp of every paper type, where an increase in the paper thickness Tp correlates to lower values for Nmax and Nt.

Herein, the "stack position" in the present embodiment refers to the stacking position at which the paper can be stacked without overlapping without lying on top of the paper of the neighboring stack position. In the present embodiment, the name "sorting" is given to processing for dividing by stack position the already-printed paper being discharged onto the stacker 23. The sorting function unit 97 carries out processing for controlling the position of the stacker 23 and switching the stack position of the paper P.

Figures 12, 13:
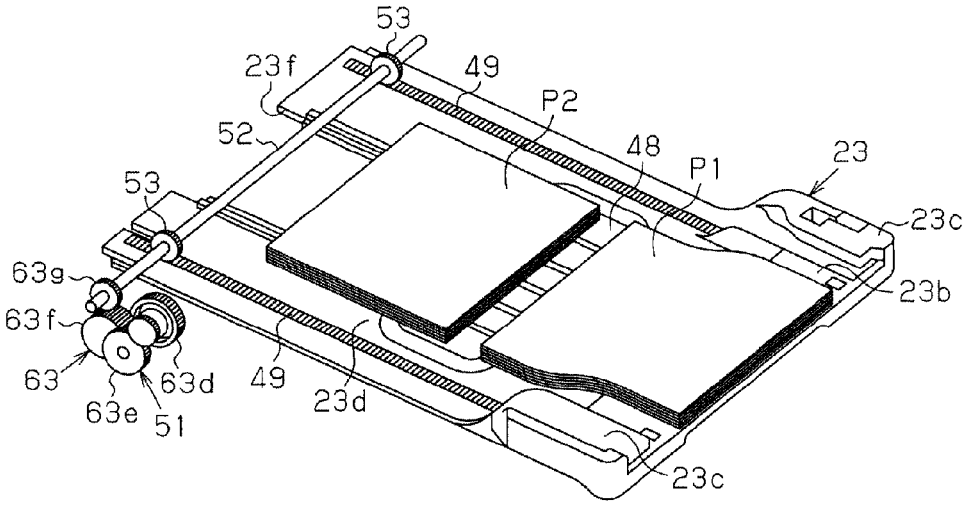
FIG. 12 is a perspective view of the stacker, for describing a stacker control in a third embodiment.
FIG. 13 is a schematic diagram for describing stack data.

The computer 75 refers to the stack data D2 illustrated in FIG. 13, and ascertains the stack number S corresponding to the paper length L. For example, in the case of a comparatively long paper length L1, it is only possible to handle a stack number S that is "1"; in the case of a paper length L2, it is possible to handle a stack number of "1" and "2", and in the case of a comparatively shorter paper length L3, it is possible to handle a stack number of "1", "2", and "3" (where L1>L2>L3).

A maximum stacking height Hmax is set to a value less than a paper discharge height Ho that is stipulated in light of the nip height between the rollers 41, 42 for discharging paper, in order to prevent a load disruption arising when subsequent paper P having been discharged at the paper discharge height Ho comes up against the group of paper that has been stacked on the stacker 23. The upper limit sheet number Nmax is set to a value that is established in accordance with the maximum stacking height Hmax and with the paper thickness Tp for every paper type (=the quotient of Hmax/Tp). FIG. 13 illustrates the stack data D2 for one paper type; the memory 86 holds stack data for every paper type.

In the present embodiment, a print setting screen displayed on the monitor of the host device 100 by the printer driver 101 displays the maximum stack number that is established on the basis of the paper size designated by the user. In a case where the user desires to stack the paper P at a plurality of stack positions on the stacker 23, the user designates the desired stack number S with an operation of the input unit 102. In a case where a value "2" or higher is set for the stack number S, then a parameter for sorting the paper can be set. A "user name", "copy" for when a plurality of different copies are being printed, "print job", and the like can be selected as the parameter. For example, in a case where a "user name" is selected, then a user-by-user sorting function for sorting the paper user by user is set. The stack number S and user identification information designated by the user are included in the header in the print job data together with the print condition information, and are sent to the printer 11 by the transmission of the print job data.

The stacker control in the printer 11 of the present embodiment shall be described below on the basis of FIG. 14. Upon receipt of the print job data, the computer 75 starts the stacker control illustrated in FIG. 14.

First, in step S31, a determination is made as to whether or not the stacker number S=1. This determination is carried out by the first determination unit 89. The first determination unit 89 acquires the stack number S included in the header in the print job data, and determines whether or not the stacker number S thereof is "1". When S=1, the flow proceeds to step S32; when S=1 is not true (i.e., when the stack number S is "2" or greater), the flow proceeds to step S33.

In step S32, the stacker 23 is driven until the detection signal of the open stacker sensor 56 reaches the H level. In other words, in a case where the stacker number S is "1", then the stacker 23 is arranged at the open position of the greatest amount of extension, irrespective of the paper length. It shall be readily understood that in a case where S=1, too, then the stacker 23 can be driven so as to reach the amount of extension that corresponds to the paper length. In a case where S1, the flow proceeds to step S37 when this process is concluded.

In step S33, the position of the stacker 23 is established. That is to say, the current position of the stacker 23 (the current amount of extension) is established from the count value of the counter of the extension amount measurement unit 95. In the next step S28, the stacker 23 is driven to the target position. More specifically, the extension amount computation unit 94 computes an amount of extension that makes it possible to stack the paper P at an initial stack position positioned further toward the distal end of the stacker 23 in the direction of protrusion. At this time, the extension amount computation unit 94 can calculate the amount of extension that corresponds to the stack position, using each of the values for the paper length L and the stack number S, or can refer to reference data in which amounts of extension corresponding to a plurality of stack positions are set for each individual paper length L and acquire the amount of extension that corresponds to the stack position at the time. For example, the amount of extension of the stacker 23 when paper P1 is being placed on a first stack position is understood herein to be similar to that of the first embodiment. An amount of extension of the stacker 23 for when paper P2 is being placed on a second stack position from the distal end side of the stacker 23 in the direction of protrusion is established by carrying out a calculation for adding the sum of the paper length and a stacker interval to the amount of extension of the first stack position. Thereinafter, the amounts of extension that correspond to the third and subsequent stack positions are also established by carrying out a similar calculation, using the amount of extension that corresponds to the stack position one prior. The "stack interval" refers to the interval in the conveyance direction Y between the paper P1 and the paper P2 in FIG. 12.

The paper P1, having been discharged after printing from the main device body 12 in this manner, is stacked at the first stack position on the stacker 23 (see FIG. 12). Then, as the paper P1 is being stacked sequentially at the first stack position on the stacker 23, the processing for a step S35 is carried out.

In step S35, a determination is made as to whether or not a stack position switch condition holds true. This determination is carried out by the first determination unit 89. In the present example, a time where the number of sheets of paper stacked onto the current stack position reaches the upper limit sheet number Nmax, a time where the user name designated for printing has been switched, a time where the copy is switched during printing of a plurality of different copies, and a time where the print job is switched are all set as stack position switch conditions. When the stack position switch conditions do not hold true, the first determination unit 89 is on standby until a stack position switch condition does hold true; when a stack position switch condition holds true, the flow proceeds to step S36. In the present example, the number of sheets of paper stacked for every stack position is counted by the sheet number counter 90 illustrated in FIG. 6.

In step S36, a determination is made as to whether or not the stack number S=1. This determination is made by the second determination unit 96. When there remains an unused stack position at which paper has not yet been stacked, such as when the paper has been stacked at the first stack position, then the stack number "S" is a value "2" or greater, and thus the flow proceeds to step S37.

In step S37, "1" is subtracted from the stack number S (S=S−1). After this subtraction, the flow returns to step S33, in which the processing for switching the stack position is carried out (S33, S34). That is to say, the position (current amount of extension) of the stacker 23 is established (S33), and the stacker 23 is driven to the target position that corresponds to the next stack position (S34). The latter processing, to be more specific, involves establishing the target amount of extension that corresponds to the next stack position of the stacker 23, and driving the electric motor 50 by an amount of rotation equivalent to the difference between the current and target amounts of extension, in the direction oriented toward the target position from the current position of the stacker 23. As a result, the stacker 23 moves in the direction of protrusion, and is arranged at a position where the paper can be stacked at the second stack position. Then, the paper P2 is stacked at the second stack position on the stacker 23, as illustrated in FIG. 12.

Then, when a stack position switch condition holds true during the stacking of the paper onto the second stack position (an affirmative determination in S35), the flow proceeds to step S36; however, in the case of the example in FIG. 12, S=1 (an affirmative determination in S36), and thus the flow proceeds to step S37.

Then, in step S38, a determination is made as to whether or not the upper limit sheet number has been reached. In this example, in a case where the number of sheets of paper stacked at the final stack position reaches the upper limit sheet number Nmax (an affirmative determination in S38), then the flow proceeds to step S40, in which an alert indicating that the paper on the stacker 23 should be taken away is issued. After this alert, the routine is completed. For this reason, when the number of sheets of paper stacked has reached the upper limit sheet number Nmax, the start of printing for the next page is temporarily stopped. Viewing either monitor of the host device 100 or the alert on the display unit 14 of the printer 11, the user takes away the paper stacked on the stacker 23, and uses the input unit 102 of the host device 100, or the operation unit 15 of the printer 11, to carry out an operation to command to restart printing, whereupon the printer 11, having received the command to restart printing restarts the print operation. When the upper limit sheet number Nmax has not been reached (a negative determination in S38), however, the flow proceeds to step S39.

In step S39, a determination is made as to whether or not a completion condition holds true. Herein, as one example, a paper presence or absence sensor (not shown) for detecting the presence or absence of the paper P on the stacker 23 is provided. The completion condition is then understood to be when the paper P on the stacker 23 has been taken away and the paper presence or absence sensor switches from a state detecting the presence of paper to a state detecting the absence of paper. For example, the completion condition holds true and the routine is completed when the user takes away the paper on the stacker 23 and the paper presence or absence sensor reaches a state detecting the absence of paper.

For example, in a case where a print job for a number of printed sheets greater than the upper limit sheet number Nmax is received, then the stacker 23 moves in the direction of opening and the stack position is altered every time the number of sheets of paper P1 stacked at the first stack position on the stacker 23 reaches the upper limit sheet number Nmax. In such a case, in the example in FIG. 12, when the paper P1, P2 printed in a single print job reaches the upper limit sheet number Nmax, then the stack position is switched and the stacking is divided between a plurality of stacks on the stacker 23.

In a case where the user has set "copy" for when a plurality of different copies are being printed as a parameter for the stack position switch condition on the print setting screen, then the stacker 23 moves in the direction of opening and the stack positions is altered every time one copy worth of printing is ended. In such a case, in the example of FIG. 12, then the paper P1, P2 on the stacker 23 is sorted copy by copy. That is to say, already-printed paper P1 for a first copy is stacked at the first stack position on the stacker 23, and already-printed paper P2 for the second copy is stacked on a second stack position on the stacker 23.

In a case where the user has set a "user name" as a parameter for the stack position switch condition on the print setting screen, then the stacker 23 moves in the direction of opening and the stack position is altered every time the user name is switched. In such a case, in the example in FIG. 12, the paper P1, P2 on the stacker 23 is sorted user by user.

In a case where the user has set "print job" as the parameter for the stack position switch condition on the print setting screen, then the stacker 23 moves in the direction of opening and the stack position is altered every time the print job is switched. In such a case, in the example in FIG. 12, the paper P1, P2 on the stacker 23 is sorted print job by print job.

Also, in the present embodiment, apart from a format for moving the stacker 23 solely in the direction of opening, the sorting function unit 97 also employs a format for moving the stacker 23 forward and back (an extension and withdrawal operation), making it possible to switch a plurality of times to the same stack position until the upper limit sheet number Nmax is reached.

For example, the already-printed paper P1 of a first user is stacked at the first stack position, and the already-printed paper P2 of the next user is stacked at the second stack position (see FIG. 12). Thereafter, in a case where the print job data for the first user is again received, then the electric motor 50 is driven in reverse to return the stacker 23 in the direction of closing by a predetermined amount, and the paper P1 is stacked at the first stack position. Thereafter, in a case where the print job data for the second user is again received, then the electric motor 50 is rotated in the open stacker direction to return the stacker 23 to the open position, and the paper P2 is stacked at the second stack position. In so doing, the paper on the stacker 23 can be sorted user by user even when printing for a plurality of sets of print job data is being carried out for each individual user.

The configuration is such that the stacker 23 is also driven forward and back with a parameter other than the user name, to sort the paper in a manner specific to the parameter. "Copies" for when a plurality of different copies are to be printed is included as a parameter, and in such a case the paper is conveyed to different stack positions in one-copy increments on the stacker 23. At this time, in a case where, even though there is paper stacked in all of the stack positions, there exists a stack position at which the upper limit stack number is less than Nmax, and where it is possible not to exceed the upper limit sheet number Nmax even when the number of printed sheets for the current copy are stacked on that stack position, then the already-printed paper P for the current copy are stacked atop the already-printed paper P of the other copies. In a case where the already-printed paper P for another print job is being stacked on the paper P that has been already stacked on the stack position, then preferably sorting for shifting the stacking position for the current upper-side paper P within a range of, for example, 3 to 30 mm in relation to the lower-side paper P is carried out so that, for example, at least half of the paper in the conveyance direction Y is overlapped.

According to the third embodiment described above, it is possible to obtain the following effects.

(10) Paper P of a comparatively shorter paper length L is stacked at a different stack position on the stacker 23, and thus a greater maximum for the number of stacked sheets of paper that can be stacked on the stacker 23 can be ensured. For this reason, it is easier to avoid a defect either where the paper P, having been stacked in excess of the upper limit for the number of stacked sheets on the stacker 23, hinders the discharging of the subsequent paper P, or where the subsequent paper P comes up against the stacked paper P and leads to a load disruption of the paper P, causing some of the paper P to fall out from the stacker 23, or the like.

(11) A time where the upper limit sheet number Nmax is reached, a time where the user is switched, a time where the copy is switched when a plurality of copies are to be printed, a time where the print job is switched, and the like are employed as the stack position switch condition. In a case where the number of printed sheets for a single print job is greater than the upper limit sheet number Nmax, then the printed paper P can be stacked separately at a plurality of stack positions. For this reason, it is easy to avoid a defect such as where, when the number of stacked sheets exceeds the upper limit sheet number, the next subsequent paper comes up against and disrupts the stacked paper, and where some of the paper falls out from the stacker 23 due to this disruption. Also, in a case where switching of the user is understood to be a stack position switch condition, then the printed articles are sorted to each of the individual stack positions on a user-by-user basis, and thus there is no need to expend effort in dividing the printed articles on a user-by-user basis. Further, in a case where switching of the print job is understood to be a stack position switch condition, then the paper can be sorted on a print job-by-print job basis, and thus there is no need to expend effort in dividing the printed articles on a print job-by-print job basis.

(12) In a case where the configuration is such that the stacker 23 is moved forward and back (an extension and withdrawal operation), then once the stacker 23 has been moved and the stack position has been changed, the stacker 23 can be either advanced or retracted to again stack the paper at the earlier stack position. Accordingly, in addition to the ability to sort the paper P to different stack positions on the stacker 23 on a parameter-by-parameter basis, it is possible to increased the number of sheets of paper stacked at each of the stack positions on a parameter-by-parameter basis. When the parameter is, for example, the user name, then in addition to the ability to sort the paper P on a user-by-user basis, it is also possible to stack printed articles of the same user that have been printed in different print jobs at the same stack position.

Fourth Embodiment

Figures 15, 16:
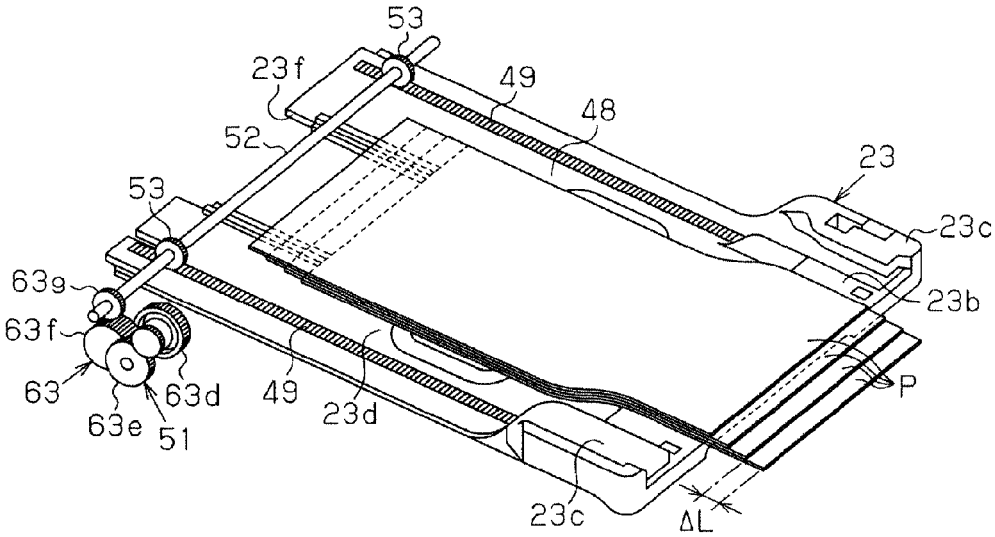
FIG. 15 is a perspective view of the stacker, for describing the stacker control in a fourth embodiment.
FIG. 16 is a schematic diagram illustrating sort data.

The fourth embodiment shall be described next, on the basis of FIGS. 15 to 17. This embodiment is an example provided with a sorting function for moving the stacker 23 to a receiving position that reaches an amount of extension for which the stacking position for the first sheet of the paper P is determined in accordance with the paper length, and shifting the stacking position of the paper P on the stacker 23 in small increments one at a time in the direction inverse to the conveyance direction Y (in FIG. 15, the leftward direction) for every sheet of paper discharged, as illustrated in FIG. 15. Configurations similar to those of the first embodiment have been omitted from this description, and are given like reference numerals in the description.

The mechanical configuration (FIGS. 1 to 5) and electrical configuration (FIG. 6) of the printer 11 is similar to that of the first embodiment. A non-volatile memory of the computer 75 stores a program illustrated by the flow chart in FIG. 17. The memory 86 also stores sort data D3 illustrated in FIG. 16. A stacker extension amount that corresponds to the ordinal number of the paper is set for every paper length in the sort data D3. Herein, a maximum value for a value representative of the "ordinal number" for every paper length in the sort data D3 serves as an upper limit for the allowable number of sorts.

In FIG. 16, the column for the stacker extension amount illustrates in parentheses the paper extension amounts for during the stacker extension amounts. The paper lengths have the relationship of size L1>L2>L3, and the "So" in the formula, indicative of the stacker extension amount, illustrates the amount of extension when the stacker 23 is fully opened. A shift amount ΔL in the direction inverse to the conveyance direction Y for the paper P during sorting is set to a value equal to the top margin. This is because in some instances, a text string such as a header can be printed in the top margin of the paper, and so this text string should be made visible from above the paper P having been sorted onto the stacker 23. In the present embodiment, the name "sorting" is given to a stepwise shifting of the arrangement of the stacker 23 in a state where the stacking position for the paper is partially overlapped with the paper discharged either in the earlier or later iteration. Accordingly, the shift amount ΔL during sorting is shorter than the paper length L (ΔL<L). Also, in the present embodiment, each of the positions of the stacker 23 when the paper P is being sorted onto the stacker 23 will be the receiving position that corresponds to the paper length.

Figure 17:
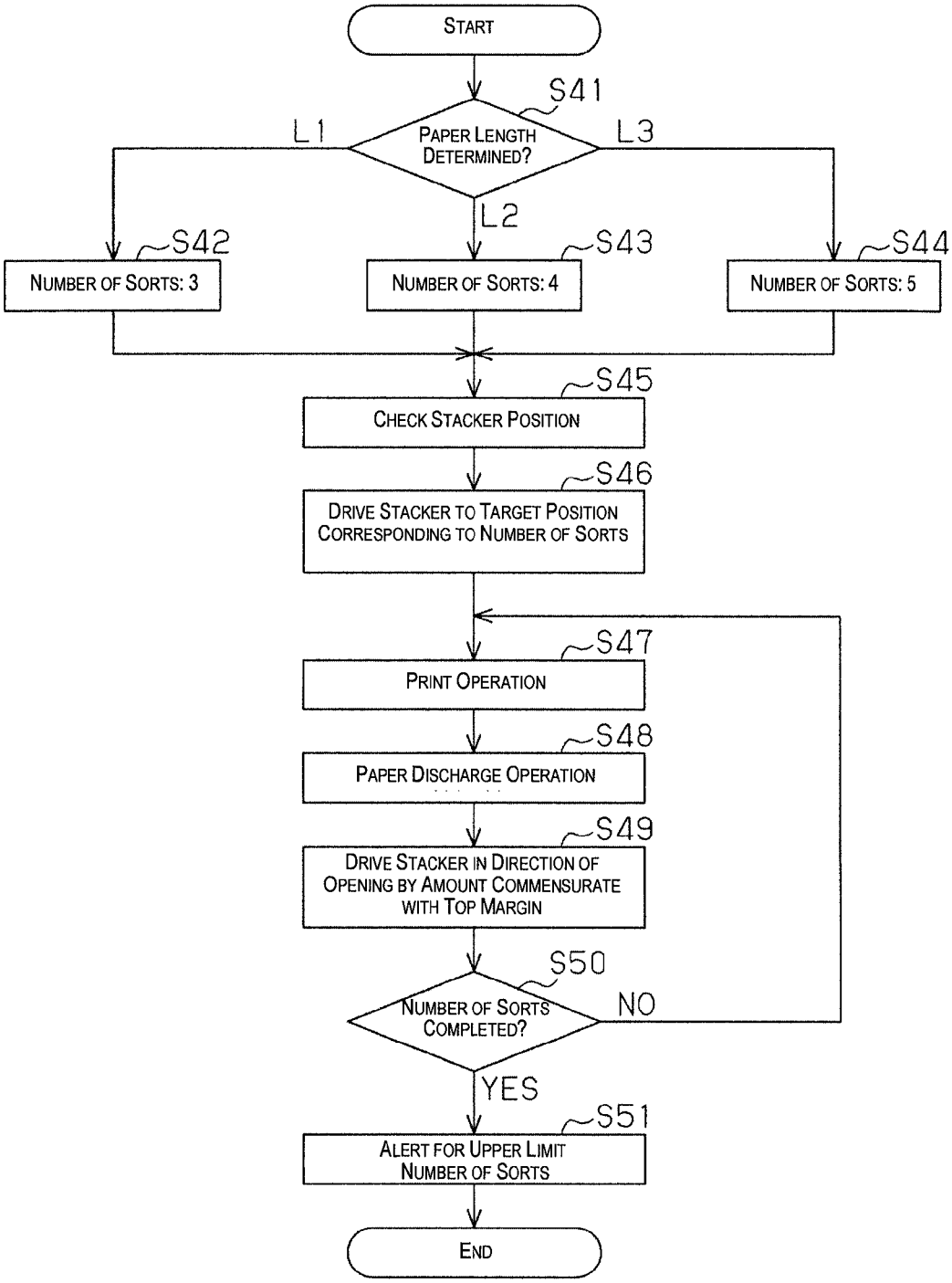
FIG. 17 is a flow chart illustrating a print control associated with a stacker control.

The following describes the stacker control in the printer 11 of the present embodiment, on the basis of FIG. 17. Upon receipt of the print job data, the computer 75 executes the stacker control illustrated in FIG. 17.

First, in step S41, the paper length is determined. This determination is made by the paper length determination unit 88. The flow transitions to step S42, to step S43, or to step S44 in the case of the paper length L1, the case of the paper length L2, and the case of the paper length L3, respectively.

In step S42, the number of sorts is set to three. That is to say, the sorting function unit 97 (see FIG. 6) consults the sort data D3 illustrated in FIG. 16, and sets the number of sorts "three" that corresponds to the paper length L1.

In step S43, the number of sorts is set to four. That is to say, the sorting function unit 97 (see FIG. 6) consults the sort data D3 illustrated in FIG. 16, and sets the number of sorts "four" that corresponds to the paper length L2.

In step S44, the number of sorts is set to five. That is to say, the sorting function unit 97 (see FIG. 6) consults the sort data D3 illustrated in FIG. 16, and sets the number of sorts "five" that corresponds to the paper length L3.

In step S45, the position of the stacker 23 is established. In step S46, the stacker 23 is driven to the target position that corresponds to the number of sorts. The sorting function unit 97 consults the sort data D3 and acquires the amount of stacker extension for the first sheet of the paper length L that was determined in step S41, and the electric motor 50 is driven so as to move the stacker 23 to the receiving position at which the amount of stacker extension is reached. At this time, the current position of the stacker 23 as confirmed in step S45 is used and the electric motor 50 is driven, by an amount of rotation that corresponds to the difference between the current and target amounts of extension, in the direction of rotation corresponding to the direction of movement in which the stacker 23 is oriented toward the target position (the target amount of extension) from the current position. In the case of, for example, a number of sorts "four", then the amount of stacker extension "So-45" corresponding to the first sheet of the relevant paper length L2 is acquired as the target amount of extension, and the electric motor 50 is driven by an amount of rotation that corresponds to the difference between the current and target amounts of extension, in the direction of rotation corresponding to the direction of movement in which the stacker 23 is oriented toward the target position (the target amount of extension) from the current position. As a result, the stacker 23 moves in the direction of protrusion to the position of the amount of extension "So-45". The target position at this time is determined in accordance with the number of sorts, which is determined in accordance with the paper length, and will thus be the receiving position of the amount of extension corresponding to the paper length.

In step S47, the print operation is carried out. The print operation is carried out by repeatedly alternating between one pass worth of printing, carried out by once moving the carriage 18 in the scan direction X, and paper feeding in which the paper P is conveyed to the next print position. One sheet of paper P is printed by this print operation.

In step S48, the paper discharge operation is carried out. As a result, the already-printed paper P is discharged from the main device body 12, and the paper P having been thus discharged is arranged at, for example, a position of a paper extension amount 45 mm on the stacker 23 at the amount of extension "So-45".

In step S49, the stacker 23 is driven in the direction of opening by an amount commensurate with the top margin.

That is to say, when the paper discharge operation is completed and the placing of the paper P on the stacker 23 is ended, then the sorting function unit 97 drives the electric motor by a corresponding amount of rotation commensurate with the top margin (commensurate with a shift amount ΔL) in the direction of rotation corresponding to the open stacker direction (for example, the direction of forward rotation). As a result, the stacker 23 moves in the direction of opening by an amount commensurate with the top margin. In the case of, for example, the number of sorts "four", the stacker 23 is arranged at the position for the amount of extension "So-30".

In step S50, a determination is made as to whether or not the number of sorts has been completed. This determination is made by the second determination unit 96. In other words, when the number of sorts that was set in which is the relevant step among steps S42, S43, and S44 has not been completed, the flow returns to step S47, and the print operation (S47) and paper discharge operation (S48) are carried out. Then, as a result of the paper discharge operation, the paper P is discharged onto the stacker 23. At this time, the stacker 23 has moved in the direction of protrusion by an amount commensurate with the top margin beyond the position during the paper discharge operation before, and thus the paper P now being discharged is arranged at a position shifted in the direction inverse to the conveyance direction Y by an amount commensurate with the top margin beyond the earlier paper P. In the case of for example, the number of sorts "four", the paper P having been thus discharged is placed onto the stacker 23 at the amount of extension "So-30" at a position for the paper extension amount 30 mm. The stacker 23 is then driven in the direction of opening by an amount commensurate with the top margin (S49).

The process for S47 to S49 is repeated until the number of sorts is completed (until an affirmative determination in S50). In the case of, for example, the number of sorts "four", then the third sheet of already-printed paper P is arranged on the stacker 23 at the amount of extension "So-15" at the position for the paper extension amount 15 mm, and the fourth sheet of already-printed paper P is arranged on the stacker 23 at the amount of extension "So" at the position for paper extension amount 0 mm. A plurality of (in the example in FIG. 15, four) sheets of the paper P is thereby placed on the stacker 23, in a state of having been sorted, as illustrated in FIG. 15. Then, when the number of sorts is completed (an affirmative determination in S50), the stacker 23 reaches a limit position on the opening side at which a sort position can no longer be ensured, and thus in step S51 an alert is issued indicating that the upper limit number of sorts has been reached. This alert is carried out by the stacker control unit 85 providing notification to the main control unit 83 and the main control unit 83 sending alert information to the host device 100 via the communication interface 71 on the basis of this notification. As a result, on the basis of the alert information, the host device 100 displays on the monitor an alert indicating that the paper should be taken out from the stacker 23, because the upper limit number of sorts has been reached. At this time, in a case where printing is underway, the start for printing the next page is temporarily stopped. When the user, having seen the alert, takes the paper stacked onto the stacker 23 out and also carries out an operation using the input unit 102 of the host device 100 or the like to command a restart for printing, the printer 11 restarts the print operation.

According to the fourth embodiment described above, it is possible to obtain the following effects.

(13) A plurality of sheets of the paper P are arranged sorted on the stacker 23, and thus when, for example, the plurality of sheets of paper P on the stacker 23 are viewed, a character string that has been printed on the header or elsewhere can be viewed directly. For this reason, the printed articles on the stacker 23 can be confirmed from the character string in the top margin without altering the stacked state thereof.

(14) Sorting is carried out by shifting in increments commensurate with the top margin, and thus the character string, such as a header, having been printed in the top margin of the paper can be reliably viewed even while still in the stacked state.

Fifth Embodiment

The fifth embodiment shall now be described, on the basis of FIGS. 18 to 20. The fourth embodiment was a configuration in which the sorting process is carried out by moving the stacker 23 to an initial receiving position (the target position) at which the amount of extension corresponding to the paper length is reached, and thereafter moving the stacker 23 in a stepwise fashion by an amount commensurate with the top margin in only one direction (for example, the direction of opening); in the present embodiment, however, the sorting process is carried out by moving the stacker 23 in both the direction of opening and the direction of closing. Configurations similar to those of the first embodiment have been omitted from this description, and are given like reference numerals in the description. The mechanical configuration (FIGS. 1 to 5) and electrical configuration (FIG. 6) of the printer 11 are similar to those of the first embodiment. The non-volatile memory of the computer 75 stores a program for print control which includes the sorting process illustrated by the flow chart in FIG. 18.

The fourth embodiment was a configuration where a sorting process in which the stacker 23 is moved little by little in the direction of opening (the direction of protrusion) is carried out, and where the sorting process is completed once the stacker 23 reaches a limit position toward the opening position at which the sorting process is possible. By contrast, in the present embodiment, a process for forming sorting layers is carried out a plurality of times by adding an operation for moving the stacker 23 in the reverse direction every time the stacker 23 reaches the limit position, to pile a subsequent sorting layer onto the layer of the first sorting (a first sorting layer) obtained when the paper P is stacked while being sorted.

Figure 19:
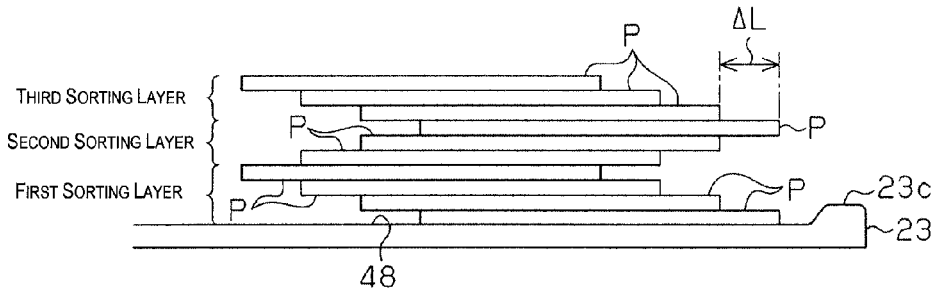
FIG. 19 is a schematic side view illustrating a paper stacking state on the stacker during reverse sorting.
Figure 20:
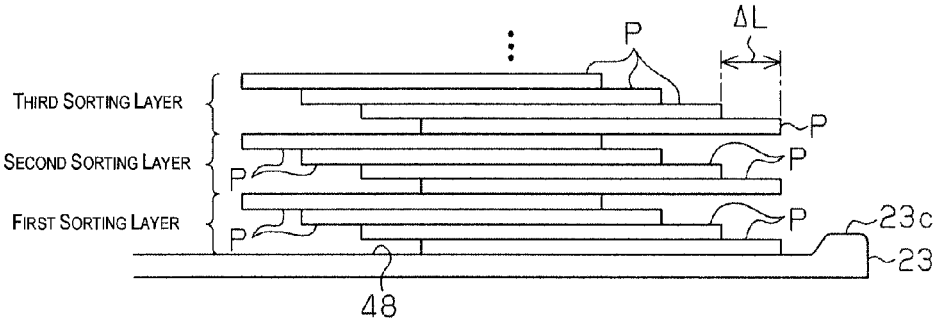
FIG. 20 is a schematic side view illustrating a paper stacking state on the stacker during repeat sorting.

The manner in which the paper is piled up when this processing for forming sorting layers is carried out a plurality of times encompasses two types of methods, illustrated in FIGS. 19 and 20. That is to say, a method of sorting illustrated in FIG. 19 is a method in which, when an m-th (where m=1, 2, . . . ) sorting process for moving the stacker 23 in a stepwise fashion is ended and the stacker 23 arrives at the limit position where the sorting process is possible, then the direction of movement of the stacker 23 is inverted and an (m+1)-th sorting process is carried out, thus carrying out the processing for sorting the paper P a plurality of times (in a plurality of layers). A method of sorting illustrated in FIG. 20 is a method in which, when an m-th (where m=1, 2, . . . ) sorting process is ended and the stacker 23 arrives at the limit position where the sorting process is possible, then the stacker 23 is momentarily returned in the reverse direction (the direction of closing) to the initial position of the m-th sorting process, and the (m+1)-th sorting process is carried out from the initial position. In the present embodiment, the name "reverse sorting" is given to the method of sorting in FIG. 19 and the name "repeat sorting" is given to the method of sorting in FIG. 20.

The direction of movement during the sorting processing that is designated for the stacker 23 is called the "designated direction". This designated direction is switched in the reverse direction for every iteration of the process for forming one sorting layer in the case of the "reverse sorting", whereas the designated direction is not switched in the case of the "repeat sorting". The designated direction is set with, for example, a flag value for a designated direction flag. As one example, the direction of opening is set in a case where the flag value=0, and the direction of closing is set in a case where the flag value=1. The computer 75 sets the flag value corresponding to the designated direction of the time for a designated direction flag, and switches the flag value every time one iteration of the process for forming a sorting layer is completed.

The print control including the stacker control of the present embodiment shall now be described with reference to FIG. 18. The user selects either the "reverse sorting" or "repeating sorting" as the method of sorting on the setting screen of either the host device 100 or the printer 11. Then, when a command to execute printing is received, the computer 75 executes the print control illustrated in FIG. 18.

Step S61 includes determining the number of sorts that corresponds to the paper length. This process is substantially similar to the process for steps S41 to S44 in FIG. 17, and includes determining the paper length and thereafter referring to the sort data D3 illustrated in FIG. 16 to determine the number of sorts corresponding to the paper length on the basis of the paper length acquired in this determination.

The processes for steps S62 to S75 are similar to the respective processes for steps S45 to S48 in FIG. 17. That is to say, the position of the stacker 23 is checked (S62), and the stacker 23 is driven to the target position that corresponds to the number of sorts (S63). The target position is equivalent to the receiving position that corresponds to the paper length. Then, when the operation for printing on the paper P (S64) is ended, the paper discharge operation for discharging the already-printed paper P is carried out (S65).

In the next step S66, the stacker 23 is driven in the designated direction by an amount commensurate with the top margin. That is to say, when the paper discharge operation is completed, the sorting function unit 97 drives the electric motor 50 in the direction of rotation that corresponds to the open stacker direction (for example, the direction of forward rotation), which is the designated direction at the time, by an amount of rotation that is equivalent to the top margin. As a result, the stacker 23 moves in the direction of opening by an amount commensurate with the top margin.

In step S67, the number of sorts is counted. In the present example, the sorting function unit 97 constituting the computer 75 sets the counter (not shown) to "1" at the start of the process for forming the sorting layers, and counts "1" in the counter every time the stacker 23 is driven by an amount commensurate with the top margin. For example, when the printing of one sheet is completed, then the process for counting with the counter is carried out to set the count thereof from "1" to "2". In this manner, the counter counters the number of sorts in each iteration of the process for forming the sorting layers.

In the next step S68, a determination is made as to whether or not the printing has been completed. As one example, the printing is determined to have been completed when one print job is ended. When the printing is not completed, the flow proceeds to step S69; in a case where printing is completed, the routine is completed.

In step S69, a determination is made as to whether or not the number of stacked sheets has reached the upper limit sheet number Nmax. Herein, the upper limit sheet number Nmax is set to a similar value to that of the third embodiment, which is determined, taking into consideration the paper thickness Tp for every paper type, from the maximum stacking height Hmax having been set to a value less than the paper discharge height Ho in order to prevent a load disruption arising when subsequent paper P having been discharged comes up against the group of paper that has been stacked on the stacker 23. When the number of stacked sheets counted by the counter has not reached the upper limit sheet number, the flow proceeds to step S71; when the upper limit sheet value has been reached, however, the flow proceeds to step S70, in which an upper limit sheet number alert is issued. This upper limit sheet number alert is carried out by stacker control unit 85 providing notification to the main control unit 83 and the main control unit 83 sending upper limit sheet number alert information to the host device 100 via the communication interface 71 on the basis of this notification. As a result, on the basis of the upper limit sheet number alert information, the host device 100 displays on the monitor an alert indicating that the paper should be taken out from the stacker 23, because the upper limit sheet number has been reached. The main control unit 83 also displays on the display unit 14 of the printer 11 an alert indicating that the paper should be taken out from the stacker 23 because the upper limit sheet number has been reached, on the basis of the notification coming from the stacker control unit 85.

In step S71, a determination is made as to whether or not the number of sorts has been completed. This determination is made by the second determination unit 96. The second determination unit 96 determines that the number of sorts has been completed when the current number of sorts, indicated by the count that has been incremented by the counter every time the stacker 23 moves in the designated direction by an amount commensurate with the top margin, reaches the upper limit for the number of sorts determined in accordance with the paper length in step S61. When the number of sorts has not been completed, the flow moves to step S64; printing of the next page (S64), paper discharging (S65), and sort driving for driving the stacker 23 by an amount commensurate with the top margin (S66) are carried out. The process for counting the number of sorts is also carried out every time the sort driving is carried out (S67). The counter increments the number of sorts, indicated by the count, every time one sheet is printed in this manner; when the number of sorts is completed (an affirmative determination in S71), the flow proceeds to step S72 to reset the count of the counter, i.e., the number of sorts, even without printing having been completed (a negative determination in S68) and even when the upper limit sheet number Nmax has not yet been reached (a negative determination in S69).

In the next step S73, setting content is determined. That is to say, the second determination unit 96 determines whether the method set by the user is the method of "reverse sorting" or the method of "repeat sorting". When the method is reverse sorting, the flow proceeds to step S74, and when the method is repeat sorting, the flow returns to step S64.

In the case of reverse sorting, the designated direction is switched in step S74. Herein, the memory 86 stores a designated direction flag indicative, by a flag value, of the designated direction during sorting processing. The stacker control unit 85 alters the setting for the designated direction to the reverse direction by switching the value of the designated direction flag in the memory 86. When the flag is, for example, "0", the switch is to "1", and when the flag is "1", the switch is to "0". The flow proceeds to step S64 when the value of the designated direction flag has been altered in the case of the reverse sorting.

When the reverse sorting has been thus designated, the designated direction is switched every time the number of sorts reaches the upper limit value, i.e., every time one iteration of the process for forming the sorting layers is ended. As a result, the second iteration of the process for forming the sorting layers is carried out by moving the stacker 23 in the direction of closing by an amount commensurate with the top margin every time discharging of one sheet of paper is ended. Further, the designated direction is again switched when, in the second iteration of the process for forming the sorting layers, the number of sorts reaches the upper limit value and the stacker 23 reaches the limit position on the closing side. In other words, the direction of movement of the stacker 23 (the designated direction) is switched in the case of the reverse sorting every time one iteration of the process for forming the sorting layers is ended. As a result, the paper P is stacked onto the stacker 23 in a state where the direction of shifting is reversed for every sorting layer, as illustrated in FIG. 19.

In a case where the repeat sorting was designated, however, then every time one iteration of the process for forming the sorting layers is ended, the position of the stacker 23 is checked (S62) and next the stacker 23 is driven to the target position that corresponds to the number of sorts (S63). In other words, the stacker 23 is moved in the direction of closing from the limit position on the open side, and arranged at the initial target position (receiving position). Then, the second iteration of the process for forming the sorting layers is carried out by moving the stacker 23 in the direction of opening by an amount commensurate with the top margin every time the discharging of one sheet of paper is ended. Further, the stacker 23 is again moved in the direction of closing and returned to the initial target position in the second iteration of the process for forming the sorting layers every time the number of sorts reaches the upper limit value and the stacker 23 reaches the limit position on the opening side. Thus, in the case of the repeating sorting, the stacker 23 is returned to the initial target position every time one iteration of the process for forming the sorting layers is ended, and the process for forming the sorting layers is carried out every time while the stacker 23 is being moved in the direction of opening from the target position. As a result, the paper P is stacked onto the stacker 23 in a state where there is shifting commensurate with the top margin in the same direction of shifting for every sorting layer, as illustrated in FIG. 20.

When the print job is ended and printing reaches completion (an affirmative determination in S68), the routine is concluded. When the number of sheets stacked onto the stacker 23 reaches the upper limit sheet number Nmax before the end of printing (an affirmative determination in S69), however, the upper limit sheet number alert (S70) is issued.

According to the fifth embodiment described above, the following effects can be obtained.

(15) The paper P can be stacked onto the stacker 23 in a state where a plurality of the sorting layers are stacked, and thus a greater maximum number of sheets stacked onto the stacker 23 can be ensured in comparison to the method of sorting in which there is only one sorting layer, illustrated in FIG. 15, of the fourth embodiment. For this reason, it is possible to reduce the frequency at which the alert is issued because the upper limit number of sorts has been reached, as per the fourth embodiment, even though there can be a remainder until the upper limit sheet number Nmax.

(16) In a case where the number of sheets stacked onto the stacker 23 reaches the upper limit sheet number Nmax, then the start of the next printing is suspended and the alert is issued, and thus it is possible to avoid a load disruption for the paper on the stacker 23.

Sixth Embodiment

The sixth embodiment shall now be described on the basis of FIGS. 21 and 22. In the fourth embodiment illustrated in FIG. 15 and the like, the sorting process for moving the stacker 23 in the direction of opening every time printing of one sheet is ended was carried out, but the present embodiment is an example also including a configuration for moving the stacker 23 every time printing of a plurality of sheets is ended. Configurations similar to those of the first embodiment have been omitted from the description, and like reference numerals are used. The mechanical configuration (FIGS. 1 to 5) and electrical configuration (FIG. 6) of the printer 11 are similar to those of the first embodiment. A non-volatile memory of the computer 75 stores a program illustrated by the flow chart in FIG. 22.

Figure 21:
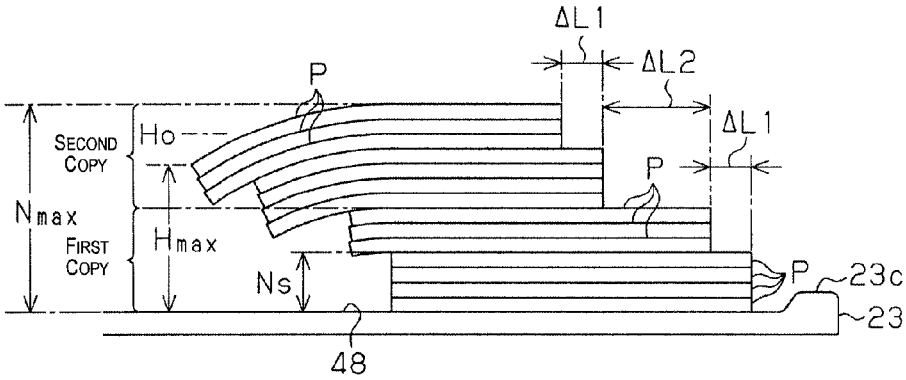
FIG. 21 is a schematic side view illustrating a paper stacking state on a stacker in a sixth embodiment.
Figure 22:
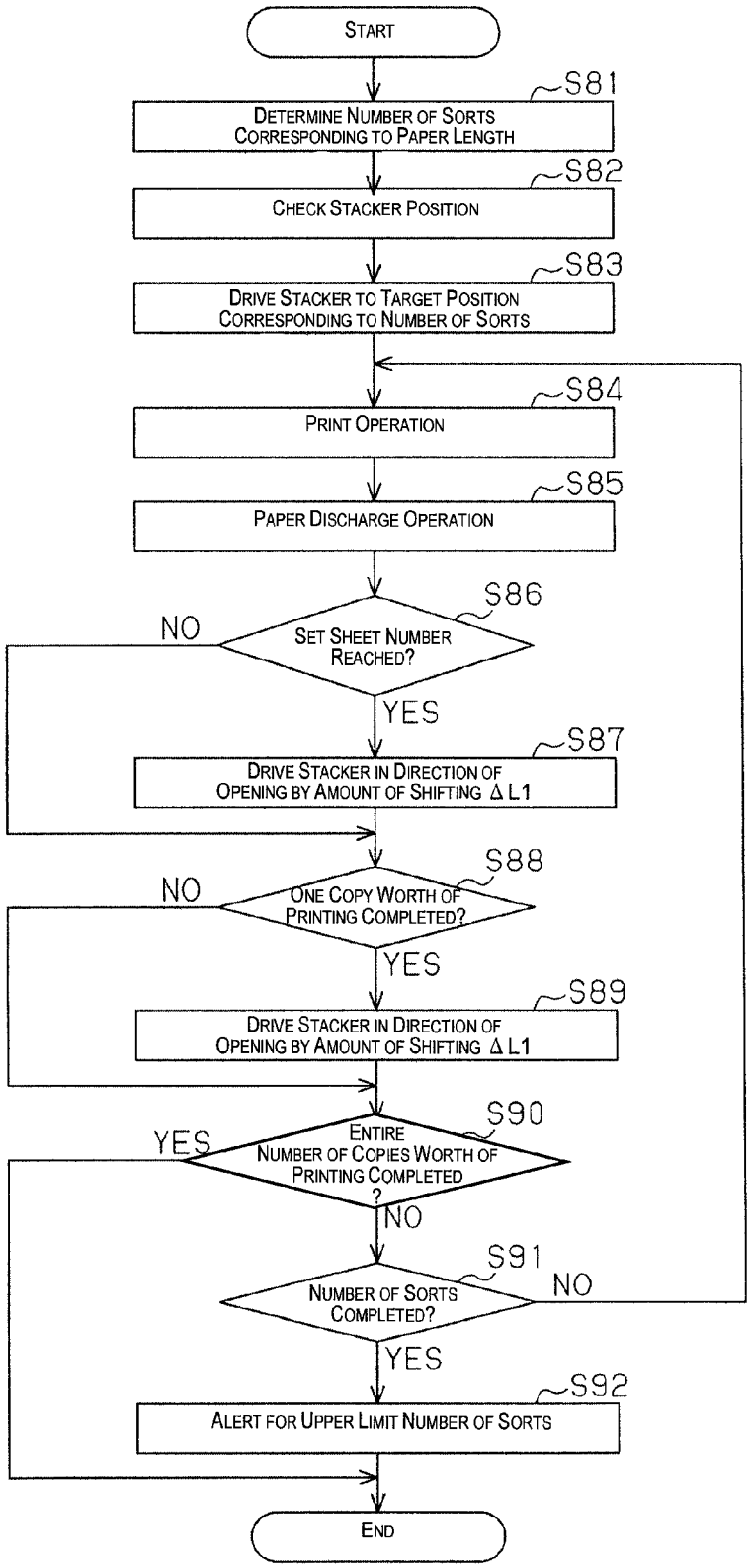
FIG. 22 is a flow chart illustrating the stacker control.

In the stacker control of the present embodiment, the paper P is stacked onto the stacker 23 in a stacked state illustrated in FIG. 21. That is to say, as illustrated in FIG. 21, the stacker 23 is moved to the initial receiving position at which the amount of extension corresponding to the number of sorts determined from the paper length is reached, and a plurality of sheets of the paper P are stacked at the receiving position with overlap until a set sheet number Ns. When the number of stacked sheets of paper P reaches the set sheet number Ns, the stacker 23 is moved in the direction of opening by an amount of shifting ΔL1, and the next receiving position is changed by the amount of shifting ΔL1. The paper P is then stacked at this receiving position. When, for example, printing commensurate with "one copy" is completed and paper P commensurate with the "one copy" is stacked onto the stacker 23, then the stacker 23 is moved in the direction of opening by an amount of shifting ΔL2 and the next receiving position is changed by the amount of shifting ΔL2. A plurality of sheets of the paper P are then stacked at this next receiving position. Thereafter, the stacker 23 is moved by the amount of shifting ΔL1 every time the number of sheets stacked for every copy unit reaches the set sheet number Ns, and the stacker 23 is moved by the amount of shifting ΔL2 every time paper P commensurate with one copy is completely stacked. Herein, in the present example, the amount of shifting ΔL2 for the copy units is set to a greater value than that of the amount of shifting ΔL1 for the set sheet number Ns units.

As illustrated in FIG. 21, a rear end portion of the upper paper P, which hangs out on the upstream side in the paper discharge direction (the left side in FIG. 21) in relation to the lower paper P, droops due to its own weight. Provided that the subsequent paper P being discharged at the paper discharge height Ho can be placed on the upper surface of the drooping portion, the subsequent paper P can be stacked onto the paper group without causing a load disruption for the paper group, even were the paper discharge height Ho to be lower than the maximum height of the portion in front of (in FIG. 21, to the right of) the paper group. For this reason, in the present embodiment, the height of the drooping rear end portion of the paper group is taken to be the maximum stacking height Hmax, as illustrated in FIG. 21. The number of sheets of paper stacked when the height of the drooping rear end portion reaches the maximum stacking height Hmax is set to be the upper limit sheet number Nmax.

Herein, the amount of drooping of the paper P fluctuates depending on the paper thickness, the amounts of shifting ΔL1 and ΔL2, the number of sheets printed per the set sheet number Ns and per one copy, the humidity, and the like, and thus these values are taken into consideration to acquire by experimentation the relationship between the number of sheets stacked and the maximum stacking height Hmax. A table of data or a calculating formula for establishing, on the basis of measured values obtained in experimentation, the upper limit sheet number Nmax with at least one parameter being the paper thickness, the amounts of shifting ΔL1 and ΔL2, the number of sheets printed per the set sheet number Ns and per one copy, and the humidity is then created and stored in the memory 86. Preferably, the upper limit sheet number Nmax is set to be less, by a predetermined number of sheets in the range of, as one example, two to 20 sheets of paper, than the number of sheets stacked when the maximum stacking height Hmax matches the paper discharge height Ho.

Also preferably, in instances where a plurality of copies are to be printed or where a plurality of sheets are to be printed, then the set sheet number Ns, the amount of shifting ΔL1, and the like are adjusted to ensure a greater amount of drooping of the paper group rear end section and set an upper limit sheet number Nmax at which a number of sheets not fewer than the total printed sheets is reached, in order to allow for all of the printed paper P to be stacked onto the stacker 23.

The print control, including the stacker control, of the present embodiment shall be described below with reference to FIG. 22. In a case where, a plurality of copies worth of printing including a plurality of sheets per copy is carried out, then the user determines print conditions including the paper type, the paper size, and the like with an operation of the input unit 102 or of the operation unit 15, thus commanding that printing be executed. When this command for the execution of printing is received, the computer 75 uses either the table of data or calculating formula stored in the memory 86 to establish the upper limit sheet number Nmax, for which drooping of the paper group rear end section is taken into consideration. The print control illustrated in FIG. 22 is executed.

Figure 18:
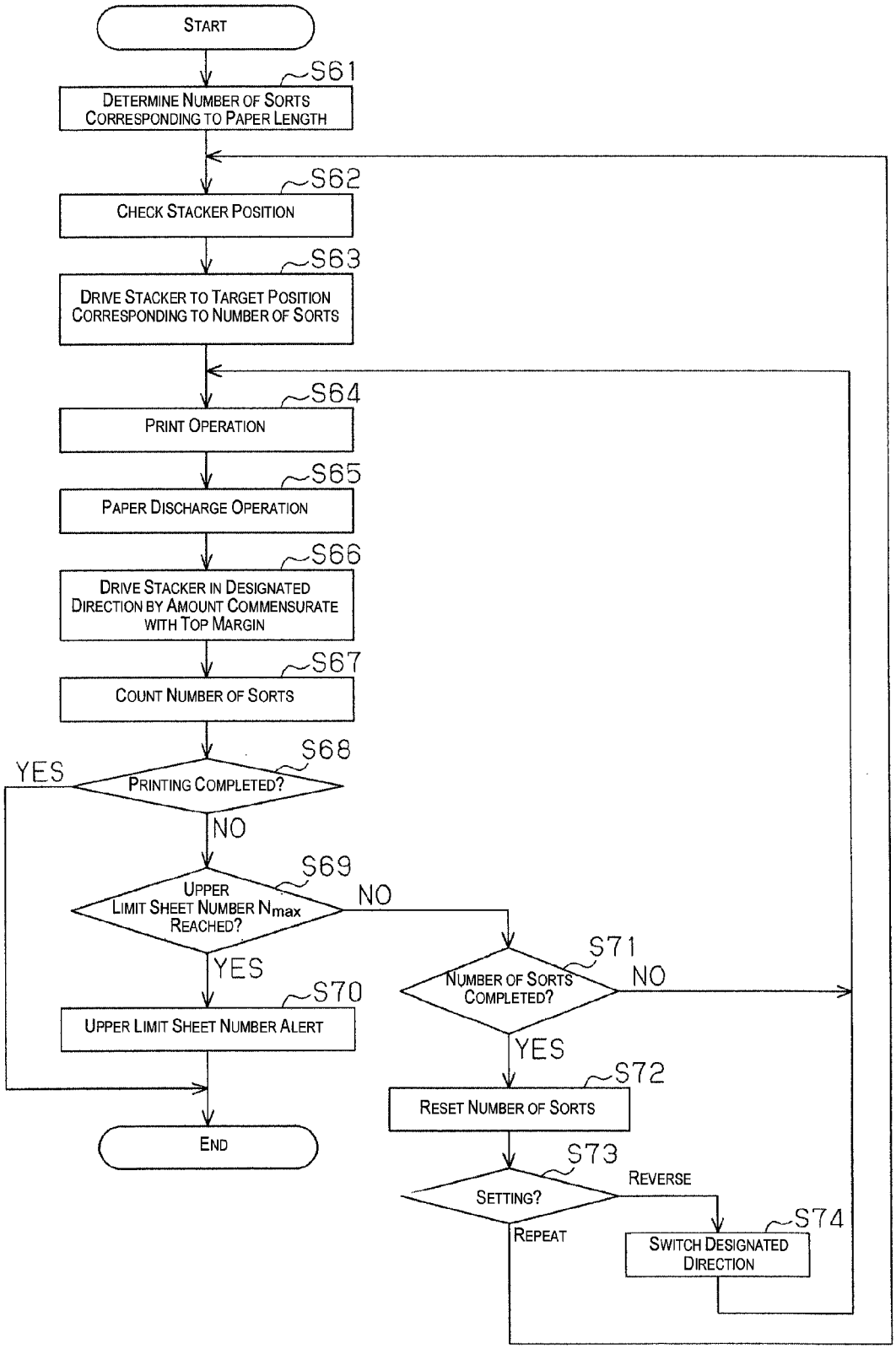
FIG. 18 is a flow chart illustrating a print control associated with a stacker control in a fifth embodiment.

First, each of the processes for steps S81 to S85 are fundamentally similar to each of the processes for steps S61 to S65 in FIG. 18 in the fifth embodiment. However, the manner in which the target position corresponding to the number of sorts (the initial receiving position) in step S83 in FIG. 22 is somewhat different. In the present embodiment, the number of sorts corresponding to the paper length L is computed using: the paper length L; the set sheet number Ns and the number of printed copies, which are sorting implementation units; the amount of shifting ΔL1 for when the set sheet number Ns is reached; and the amount of shifting ΔL2 for upon completion of every copy worth of printing. For example, the example in FIG. 21 includes carrying out two copies worth of printing, which includes one sorting for every set sheet number Ns (in FIG. 21, as one example, this is four sheets) per one copy, and thus there are two sorts for the amount of shifting ΔL1 and two sorts for the amount of shifting ΔL2. Next, a determination is made as to whether or not two sorts each for the amounts of shifting ΔL1, ΔL2 is possible in the case of the paper length L. At this time, the stacker control unit 85 calculates a target position which is in a range where the amount of projection of the paper P from the distal end of the stacker is not greater than the set value (%) less than half of the paper length L, and which satisfies conditions under which it is possible to implement two sorts for each of the amounts of shifting ΔL1 and ΔL2, which satisfy ΔL1<ΔL2 (S83). In the present example, for example, a range 30% or less in relation to the paper length L is employed as the range not greater than the set value (%) of the paper length L. The target position is also determined so as to set at a negative value (%) the instances where the leading end of the paper will be positioned further in the direction of closing than the distal end of the stacker, and so as to satisfy −20% or greater. In this manner, the stacker control unit 85 determines the number of sorts that corresponds to the paper length L using the paper length L, the set sheet number Ns, the number of printed copies, and the amounts of shifting ΔL1, ΔL2, and determines the target position that corresponds to the paper length L at which the number of sorts can be handled.

In a case where many sheets are being printed and where, while the amounts of shifting ΔL1, ΔL2 remain, the total number of printed sheets is in excess of the upper limit sheet number Nmax and yet this excessive number of sheets remains at a predetermined number of sheets or fewer, then the set sheet number Ns and the amounts of shifting ΔL1, ΔL2 are adjusted so that an upper limit sheet number Nmax not less than the total number of printed sheets is obtained. In a case where the number of sorts is in excess of the upper limit number of sorts and sorting becomes no longer possible midway during printing, then an adjustment for either increasing the set sheet number Ns and reducing the number of sorts or for shortening the amounts of shifting ΔL1, ΔL2 is carried out so as to reach a number of sorts not greater than the upper limit number of sorts. In a case where sorting cannot be handled even when the aforementioned adjustment is carried out, then a notification indicating that printing should be temporarily stopped unless the paper is taken out from the stacker 23 midway during printing can be issued in advance.

In step S83, the stacker 23 is driven to the target position that corresponds to the number of sorts. Then, when the first sheet is completely printed and discharged (S84, S85), the already-printed paper is discharged onto the stacker 23 having been arranged at the target position (the initial receiving position), and is stacked onto the stacker 23.

In step S86, the second determination unit 96 determines whether or not the set sheet number Ns has been reached. In a case where the set sheet number Ns has been reached, in then step S87 the stacker 23 is driven in the direction of opening by the amount of shifting ΔL1. In a case where the set sheet number Ns has not been reached in S86, however, then the flow proceeds to step S88.

In step S88, a determination is made as to whether or one copy worth of printing has been completed. The completion of one copy worth of printing is ascertained by a notification coming from either the main control unit 83 or the print control unit 84. In a case where one copy worth of printing has been completed, then in step S89 the stacker 23 is driven in the direction of opening by the amount of shifting ΔL2.

In step S89, the stacker 23 is driven in the direction of opening by the amount of shifting ΔL2. In the next step S90, the second determination unit 96 determines whether or not the entire number of copies worth of printing has been completed (in the example in FIG. 21, this is the completion of two copies worth). When the entire number of copies worth of printing has not been completed, i.e., when some printing still remains to be completed, then the flow proceeds to step S91; when the entire number of copies worth of printing has been completed, then the routine is completed.

In step S91, the second determination unit 96 determines whether or not the number of sorts has been completed. In other words, the second determination unit 96 determines whether or not the upper limit number of sorts has been exceeded. When the number of sorts has been completed, then in step S92 an alert indicating that the upper limit number of sorts has been exceeded is issued. This alert is issued by cause the screen of the printer 11 or the host device 100 to display an alert message via the main control unit 83. The alert message includes, for example, text indicating that printing has been temporarily stopped because of the inability to sort, text indicating the need to take out the paper on the stacker 23 in order to restart printing, and the like. In a case where the number of sorts has not been completed in step S91, however, then the flow returns to step S84.

In a case where the entire number of copies worth of printing has not been completed (a negative determination in step S90) and where the number of sorts has not been completed, either (a negative determination in step S91), then printing and discharging of the paper P is repeated. Every time the number of discharged sheets reaches the set sheet number Ns midway during printing (an affirmative determination in step S86), the stacker 23 is driven in the direction of opening by the amount of shifting ΔL1 (step S87), and every time one copy worth of printing is completed (an affirmative determination in step S88), the stacker 23 is driven in the direction of opening by the amount of shifting ΔL2.

Thus, as illustrated in FIG. 21, the already-printed paper is sorted onto the stacker 23 by the amount of shifting ΔL1 every time the set sheet number Ns is reached; every time one copy worth of printing is completed, two copies worth of printed paper P is stacked thereon in a state of having been sorted by the amount of shifting ΔL2 (>ΔL1). In a case where, for example, the number of copies printed is three copies or more, then likewise the sorting with the amount of shifting ΔL1 is carried out for every set sheet number Ns in each of the copies, and sorting with the amount of shifting ΔL2 is carried out for every copy.

The rear end portion of the paper group droops under its own weight even though the stacking height of the forward portion of the paper group having been stacked onto the stacker 23 is higher than the paper discharge height Ho, and thus the paper P having been discharged is placed on the upper surface of the drooping rear end portion and conveyed along the upper surface thereof, and is thereby stacked atop the paper group. This manner of making use of the drooping of the paper P makes it possible to stack more paper P than the anticipated number of sheets stacked onto the stacker 23.

In a case where the number of sheets of paper stacked onto the stacker 23 reaches the upper limit sheet number Nmax, then the print operation is temporarily stopped and an alert indicating that the paper should be taken out from the stacker 23 is issued. Printing is restarted when the user takes out the paper P on the stacker 23 and operates the operation unit 15 to command that printing be restarted. In a case where the set sheet number Ns is set to "0", then the already-printed paper P is sorted for every copy by moving the stacker 23 in the direction of opening by the amount of shifting ΔL2 for every copy worth of printing.

According to the sixth embodiment described above, the following effects can be obtained.

(17) As illustrated in FIG. 21, carrying out sorting in which the receiving position of the stacker 23 is changed for every copy unit and for every set sheet number Ns causes a drooping to be formed at the rear end portion of the group of paper P having been stacked on the stacker 23, due to its own weight, and the discharged paper P is moved along the upper surface of the drooping rear end portion so as to be stacked onto the paper group. For this reason, in comparison to a case where the paper P is stacked without sorting, the upper limit sheet number Nmax can be further increased and a greater amount of paper P can be stacked onto the stacker 23.

(18) The amount of shifting ΔL2 for the copy units is set so as to be longer than the amount of shifting ΔL1 for the set sheet number Ns units, and thus it is relatively easy to discriminate between a sorting location for the copy units and a sorting location for the set sheet number Ns units. Also, because the amount of shifting ΔL2 is longer than the amount of shifting ΔL1, it is relatively easy to divide the paper P for every copy unit.

(19) When the number of sorts is in excess of the upper limit number of sorts, then the print operation is temporarily stopped and also an alert for the upper limit number of sorts, indicating that no further sorting is possible, is issued, and thus it is possible to avoid a load disruption arising because the subsequently discharged paper P comes up against the paper having been stacked onto the stacker 23.

The embodiments described above can also be altered to the following modes.

The configuration can be such that an alert is issued in a case where the designated paper size and the actual paper size are different from each other. Methods of alerting herein can include issuing a sound, producing a display on the display unit 14 of the operation panel 13 of the printer 11, notifying the host device 100, and so forth.

The user can be prompted to re-enter the settings in a case where the designated paper size and the actual paper size are different from each other. As a method for prompting re-entering of the settings, either a display prompting a re-entering of the settings can be issued on the display unit 14 of the printer 11, or a notification prompting a re-entering of the settings can be carried out on the host device 100.

The configuration can be such that in a case where the designated paper size and the actual paper size are different from each other, then the amount of extension of the stacker 23 is re-adjusted to match the actual paper size. Methods for detecting the actual paper size include the following. There is provided a sensor capable of detecting the position of a paper guide provided to the supply cassette 16, the paper size being detected by this sensor. The paper width of the fed paper is detected with a paper width sensor provided to the carriage 18, and the paper size is estimated on the basis of the detected paper width.

After the stacker has been moved to the opening position for the greatest amount of extension, the stacker can be pulled back to switch the stacker position in conformity with a predetermined number of printed sheets.

After the stacker has been moved to the opening position for the greatest amount of extension, a control for pulling back the stacker in a stepwise manner can be carried out, to carry out a sorting process for shifting the paper in an overlapped state.

A control for withdrawing the stacker 23 can be carried out when there is no print job after a predetermined period of time has elapsed. In such a case, preferably, there is provided a sensor capable of detecting whether or not there is paper on the stacker 23, and the stacker 23 is pulled back in a case where a lack of paper (failure to take the printed articles) indicating that there is no paper on the stacker 23 is detected. In such a case it is possible to prevent printed articles from falling out from the stacker, because the stacker 23 will not be pulled back to the closed position in a case where there has been a failure to take the printed articles.

The rate of discharge for when the already-printed paper is being discharged can be lowered in a case where the sorting function is being used. According to such a configuration, sorting can be further prevented from being disrupted. Herein, "when paper is being discharged" more specifically refers to a timing somewhat prior to when the nip of the discharge rollers is released; thus, the rate of discharge would be lowered for slower discharging when the nip of the discharge rollers is released. According to such a configuration, the throughput can be increased as much as possible in comparison to a configuration for overall slow conveyance inclusive of conveyance during printing, because the configuration is one of slow conveyance only when the paper is being discharged.

The inputting of the print condition information is not limited to a method in which the user starts up the printer driver 101 and operates the input unit 102; rather, the print condition information, inclusive of the paper type, paper size, and the like, can also be inputted to the printer 11 by operating the operation unit 15 on the operation panel 13 of the printer 11. It would suffice also to enter only at least the paper size. The paper length can also be inputted. In summary, it should be possible to acquire the length of the medium in the direction in which the already-recorded medium is being discharged.

In the second embodiment, the extension amount measurement unit can be forgone. Once the position of the stacker 23 has been established, the electric motor 50 is driven in a direction for eliminating the difference between the current position after the establishing of the position and the target position, by an amount of rotation corresponding to this difference. According to this configuration, when the extension amount measurement unit 95 is forgone, it is still possible to arrange the stacker 23 at a target position at which the amount of extension corresponding to the paper length is reached, with relatively favorable positional accuracy.

In the second embodiment, the amount of extension of the stacker 23 that corresponds to the paper length is not limited to being a value at which the paper extension amount reaches 10%. The paper P will not fall out from the stacker 23 provided that the amount whereby the paper P projects out from the distal end of the stacker 23 is set to a range less than half of the paper length. From the standpoint of making it easy to take the paper out and of preventing the paper from falling out, the paper extension amount is preferably set to a value in the range of, for example, 5 to 30% the paper length.

In the fourth embodiment, the amount of extension of the stacker 23 was adjusted to shifting the loading position every time one sheet of paper was loaded, but it would also be possible to employ a configuration in which the amount of extension of the stacker 23 is adjusted to shift the stacking position little by little every time a plurality of sheets of paper are completely stacked at the same position. The amount by which the loading position for the paper is shifted is also not limited to being commensurate with the top margin; rather the value can be a constant, or can be set to a length that is a set percentage of the paper length. The amount by which the loading position for the paper is shifted can also be gradually lengthened or gradually shortened.

In the fourth through sixth embodiments, when sorting was started, first the stacker 23 was moved to the target position (the receiving position), and the stacker 23 was moved in the direction of opening from the target position, but it would also be possible to employ a sorting process in which the stacker 23 is initially moved to a target position for the maximum amount of extension (as one example, the open position) of the amount of extension corresponding to the paper length, following which the; stacker is moved in a stepwise manner in the direction of closing from the target position.

The angle of rotation (angle of posture) of the operation panel 13, which rotates jointly during the operation of the stacker 23 in the direction of opening from the closed position, can be smaller than the angle of rotation for the open position (i.e., the maximum angle of rotation), provided that the angle not intersect with the movement route of the stacker 23. The operation panel 13 and the stacker 23 also need not be interlockingly moved, by rather the operation panel 13 can rotate first to a position where the operation panel 13 will not interfere with the stacker 23, the movement of the stacker 23 from the closed position then being started after this rotation is completed. The operation panel 13 and the stacker 23 also can be driven by the power of different power sources.

A power source for the stacker and a power source for the operation panel can be provided separately from each other. In such a case, one electric motor can be added in FIG. 6 as the power source for the operation panel, or the conveyance motor 33 can double as either the power source for the stacker or as the power source for the operation panel.

The determination unit can determine the length of the medium (for example, the paper length) indirectly. For example, the configuration can be such that a memory stores a table of data in which medium sizes (paper sizes) and stacker extension amounts are associated with each other, and this table of data is consulted to acquire the stacker extension amount that corresponds to the medium size. In such a case, determining the medium size for establishing the length of the medium is equivalent to an indirect determination of the length of the medium.

The host device 100 can be a personal computer or otherwise can be a mobile terminal (a smartphone or the like).

Provided that the stacker 23 is a one-stage type, there is not necessarily any limitation to a single tray structure. For example, provided that the stacker is a one-stage type, the structure can be a box structure including a box opened from above, or can be a shaft type in which a plurality of shafts are arranged side by side in parallel to receive the medium.

The configuration can be such that that operation panel is not provided with operation units such as an operation switch, but rather is provided solely with a touch panel display unit whereby touching the screen with the hand enables an input operation.

The power sources are not limited to being rotary motors, but can rather be linear motors.

The medium is not limited to being a sheet of paper, but rather can also be a resin film, a metal foil, a metal film, a composite film of resin and metal (a laminate film), a textile, a non-woven fabric, a ceramic sheet, or the like.

The recording device is also not limited to being of the inkjet type, but rather can be of the dot impact type or laser type. Further, the recording device is not limited to being a serial printer, but rather can be a line printer or a page printer. For example, in a line printer, conveyance of the medium and recording onto the medium are carried out at the same time, and the timing for starting the movement of the stacker to the position at which the amount of extension corresponding to the length of the medium is reached in the panel and stacker operation in the first embodiment is a timing during conveyance and during recording.

The recording device need only have at least a recording function (print function) for forming an image on the medium, and can be, for example, a multifunction peripheral provided with a print function, a scanner function, and a copy function.

In each of the embodiments described above, the recording device was embodiment in an inkjet printer, which is one form of a liquid ejection device, but in instances of application to a liquid ejection device, there is no limitation to being a printer, and the recording device could also be embodied in a liquid ejection device for either ejecting or discharging a liquid other than ink (including a liquid form obtained by dispersing or mixing particles of a functional material into a liquid, or a fluid form such as a gel). For example, the recording device can be one that ejects, onto a sheet substrate serving as one example of the medium, a liquid that includes a dispersed or dissolved material, such as an electrode material or colorant (a pixel material) used in the manufacture of liquid crystal displays, electroluminescence (EL) displays, and surface emitting displays. When the amount of extension of the stacker is adjusted in accordance with the length of the medium, then the sheet substrate or the like can be received at an appropriate position on the stacker, and moreover because there is one (single-stage) stacker 23, the stacker 23 can be moved in a more unencumbered manner than a multi-stage stacker. In this manner, the medium (recording medium) can also be a substrate on which an element, wiring, or the like is to be formed by inkjet. The "liquid" ejected by the liquid ejecting apparatus encompasses liquids (including inorganic solvents, organic solvents, solutions, liquid resins, liquid metals (metal melts), and the like), liquid bodies, fluid bodies, and so forth.

The following sets forth technical concepts that are ascertained from each of the embodiments and modification examples described above.

(1) The recording device as set forth in any of claims 1 to 9, characterized in that the control unit starts the movement of the stacker to the receiving position from the withdrawn position at a timing during conveyance of the medium by the conveyance unit and/or a timing during recording by the recording unit. According to this configuration, first the conveyance of the medium by the conveyance unit and/or the recording on the medium by the recording unit is started, and the movement of the stacker from the withdrawn position to the receiving position at which the amount of extension based on the length of the medium is reached is started at a timing during the conveyance and/or during the recording. For this reason, the throughput can be improved, because the print operation by conveying the medium and recording onto the medium is started earlier than the timing for starting movement of the stacker.

What is claimed is:

1. A recording device comprising:

a supply cassette configured to hold a medium;

a conveyance unit configured to convey the medium;

a determination unit configured to determine a length of the medium in a direction of conveyance of the medium;

a recording unit configured to record onto the medium being conveyed;

one stacker that is able to move between a withdrawn position and a plurality of receiving positions for receiving an already-recorded medium that has been discharged, the receiving positions including a position at which an amount of extension that corresponds to the length of the medium is reached, the stacker being located above the supply cassette when the stacker is in the withdrawn position;

a power source configured to drive the stacker; and a control unit configured to control the power source and to move the stacker to one of the receiving positions, wherein the plurality of receiving positions are positions at which the medium can be stacked onto a plurality of respective stack positions on the stacker, and the control unit changes the stack position so that a number of stacked sheets of the medium is not greater than an upper limit value at each of the stack positions.

2. The recording device as set forth in claim 1, wherein the control unit changes the receiving position of the stacker by increasing the amount of extension of the stacker in a stepwise manner.

3. A recording device comprising:

a supply cassette configured to hold a medium;

a conveyance unit configured to convey the medium;

a determination unit configured to determine a length of the medium in a direction of conveyance of the medium;

a recording unit configured to record onto the medium being conveyed;

one stacker that is able to move between a withdrawn position and a plurality of receiving positions for receiving an already-recorded medium that has been discharged, the receiving positions including a position at which an amount of extension that corresponds to the length of the medium is reached, the stacker being located above the supply cassette when the stacker is in the withdrawn position;

a power source configured to drive the stacker; and a control unit configured to control the power source and to move the stacker to one of the receiving positions, wherein in a case where a plurality of copies are to be recorded, the control unit changes the receiving position of the stacker when the discharging of the last sheet of the medium in a current copy is completed, and prior to the discharging of a first sheet of the medium for a next copy.

4. The recording device as set forth in claim 3, wherein the control unit changes the receiving position of the stacker by moving the stacker forward and back in a direction of movement.

5. A recording device comprising:

a supply cassette configured to hold a medium;

a conveyance unit configured to convey the medium;

a determination unit configured to determine a length of the medium in a direction of conveyance of the medium;

a recording unit configured to record onto the medium being conveyed;

one stacker that is able to move between a withdrawn position and a plurality of receiving positions for receiving an already-recorded medium that has been discharged, the receiving positions including a position at which an amount of extension that corresponds to the length of the medium is reached, the stacker being located above the supply cassette when the stacker is in the withdrawn position;

a power source configured to drive the stacker; and a control unit configured to control the power source and to move the stacker to one of the receiving positions, wherein the control unit controls the power source to move the stacker to a second receiving position at which a part of a leading end side of a discharged already-recorded medium in the direction of discharging projects out beyond an end section of the stacker toward the direction of discharging of the discharged already-recorded medium, and the length by which the part of the leading end side projects out is less than half of the length of the already-recording medium in the direction of discharging.

6. A recording device comprising:

a conveyance unit configured to convey a medium;

a determination unit configured to determine a length of the medium in a direction of conveyance of the medium;

a recording unit configured to record onto the medium being conveyed;

a stacker capable of moving between a receiving position for receiving an already-recorded medium having been discharged and a withdrawn position, the receiving position including a position at which an amount of extension that corresponds to the length of the medium is reached;

an operation panel capable of rotating between a closed position intersecting with a movement route of the stacker and an open position not intersecting with the movement route;

a power source configured to drive the stacker;

an operation panel power source configured to drive the operation panel; and a control unit configured to control the power source to move the stacker to the receiving position, and controlling the operation panel power source to rotate the operation panel;

wherein the control unit avoids contact between the stacker and the operation panel to move the stacker to the receiver position by causing the operation panel to rotate in a direction going from the closed position toward the open position either during the driving of the stacker from the withdrawn position or prior to the driving.

* * * * *